US011254148B2

(12) United States Patent
Hamada et al.

(10) Patent No.: US 11,254,148 B2
(45) Date of Patent: Feb. 22, 2022

(54) MEDIUM PROCESSING APPARATUS, LOADING APPARATUS AND MEDIUM LOADING METHOD

(71) Applicant: SEIKO EPSON CORPORATION, Tokyo (JP)

(72) Inventors: Nobuhiko Hamada, Shiojiri (JP); Hiroto Miyauchi, Matsumoto (JP); Kazuaki Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 90 days.

(21) Appl. No.: 16/911,928

(22) Filed: Jun. 25, 2020

(65) Prior Publication Data

US 2020/0406646 A1 Dec. 31, 2020

(30) Foreign Application Priority Data

Jun. 28, 2019 (JP) ..... JP2019-121900

(51) Int. Cl.

| | |
|---|---|
| ***B41J 13/10*** | (2006.01) |
| ***B41J 15/04*** | (2006.01) |
| ***B65H 16/02*** | (2006.01) |
| ***B65H 31/20*** | (2006.01) |
| ***B65H 31/04*** | (2006.01) |
| *B65H 31/00* | (2006.01) |

(52) U.S. Cl.

CPC ..... *B41J 13/106* (2013.01); *B41J 15/04* (2013.01); *B65H 16/023* (2013.01); *B65H 31/04* (2013.01); *B65H 31/20* (2013.01); *B65H 31/00* (2013.01); *B65H 2701/11312* (2013.01); *B65H 2801/03* (2013.01)

(58) Field of Classification Search

CPC ..... B41J 13/106; B41J 15/04; B65H 16/023; B65H 31/04; B65H 31/20; B65H 31/00; B65H 2701/11312; B65H 2801/03

See application file for complete search history.

(56) References Cited

U.S. PATENT DOCUMENTS

| | | | | |
|---|---|---|---|---|
| 6,568,865 | B1 * | 5/2003 | Fujioka | B65H 31/02 271/207 |
| 9,738,482 | B2 * | 8/2017 | Aoyagi | B65H 37/06 |
| 2010/0111584 | A1 * | 5/2010 | Shiohara | G03G 15/6552 399/405 |

(Continued)

FOREIGN PATENT DOCUMENTS

| | | |
|---|---|---|
| JP | 2001-247246 | 9/2001 |
| JP | 2002-205862 | 7/2002 |
| JP | 2017-065842 | 4/2017 |

*Primary Examiner* — Henok D Legesse

(74) *Attorney, Agent, or Firm* — Workman Nydegger

(57) ABSTRACT

A medium processing apparatus includes a printer, a supporting member having a sheet-like shape and configured to support a discharged medium, and a winding unit configured to wind the supporting member and move with respect to the printer. The winding unit has a first case and a second case that rotatably support a winding shaft, and a placement portion placed at a flat surface. The first case and the second case in a state where axis lines of respective bearing portions that support the winding shaft are aligned with each other and in a state of being held so as to be mutually non-rotatable in a plane orthogonal to an axis line of the winding shaft, and when the winding unit is installed on a flat surface, the placement portion contacts the flat surface.

16 Claims, 9 Drawing Sheets

(56) References Cited

U.S. PATENT DOCUMENTS

| | | | | |
|---|---|---|---|---|
| 2011/0024975 | A1* | 2/2011 | Saito | B65H 31/22<br>271/207 |
| 2017/0088384 | A1 | 3/2017 | Asai et al. | |

* cited by examiner

MEDIUM PROCESSING APPARATUS, LOADING APPARATUS AND MEDIUM LOADING METHOD

The present application is based on, and claims priority from JP Application Serial Number 2019-121900, filed Jun. 28, 2019, the disclosure of which is hereby incorporated by reference herein in its entirety.

BACKGROUND

1. Technical Field

The present disclosure relates to a medium processing apparatus, a loading apparatus, and a medium loading method.

2. Related Art

JP-A-2017-65842 discloses a medium processing apparatus capable of loading various types and sizes of paper discharged from a discharge port of a printing apparatus. A receiving sheet for loading discharged paper can be wound so that a user can change a length of the receiving sheet as an example of a sheet-like supporting member, depending on a type and a size of the paper.

Both ends of a top rod as an example of a winding shaft around which the receiving sheet is wound are each attached to a tip of a side rod. Base ends of respective two number of the side rods are rotatably attached to a leg portion that supports a printer portion as an example of a housing. By rotating the two side rods at a desired angle, it is possible to change a position of the winding shaft.

In the medium processing apparatus described in JP-A-2017-65842, when changing a winding amount of the sheet-like supporting member such as the receiving sheet, in order to suppress twisting or wrenching in the winding shaft that winds the sheet-like supporting member, it is desirable to simultaneously operate the two side rods. However, a size of the housing of the printing apparatus is large, and thus it is very difficult to operate the angle of the two side rods simultaneously. Thus, there is a demand for a configuration that can suppress external force loads such as twisting force and wrenching force acting on the winding shaft due to position shift of parts that support both end portions of the winding shaft respectively.

SUMMARY

A medium processing apparatus for solving the above-described problems includes, a printer provided with a discharge unit for discharging a processed medium, a supporting member having a sheet-like shape and fixed, in part, to the printer, and moreover configured to support the medium discharged from the discharge unit, and a winding unit configured to wind the supporting member and move with respect to the printer, wherein the winding unit includes a winding shaft to which one end of the supporting member is attached, a rotation mechanism including a winding mechanism rotating the winding shaft in a direction of winding the supporting member and a stop mechanism configured to stop the winding shaft, in a first state in which a length of the supporting member unwound from the winding shaft is a first unwind amount, and in a second state in which a length of the supporting member unwound from the winding shaft is a second unwind amount that is greater than the first unwind amount, a first case positioned at one outer side of the supporting member in an axial direction of the winding shaft and rotatably supporting the winding shaft, a second case positioned at another outer side of the supporting member in the axial direction and rotatably supporting the winding shaft, and a placement portion that, when the winding unit is placed at a flat surface, contacts the flat surface.

A loading apparatus for solving the above-described problems is a loading apparatus that includes, a supporting member having a sheet-like shape and fixed, in part, to a printer and used and moreover configured to support a medium discharged from a discharge unit of the printer, and a winding unit configured to wind the supporting member, wherein the winding unit includes a winding shaft to which one end of the supporting member is attached, a rotation mechanism including a winding mechanism for rotating the winding shaft in a direction of winding the supporting member and a stop mechanism configured to stop the winding shaft, in a first state in which a length of the supporting member unwound from the winding shaft is a first unwind amount and in a second state in which a length of the supporting member unwound from the winding shaft is a second unwind amount that is greater than the first unwind amount, a first case positioned at one outer side of the supporting member in an axial direction of the winding shaft and rotatably supporting the winding shaft, a second case positioned on another outer side of the supporting member in the axial direction and rotatably supporting the winding shaft, and a placement portion that, when the winding unit is placed at a flat surface, contacts the flat surface.

A media loading method for solving the above-described problem is a medium loading method for loading a processed medium discharged from a discharge unit of a printer with use of a loading apparatus including the winding unit and the supporting member in the medium processing apparatus, wherein the printer includes a support shaft at which the supporting member is hung and which supports the supporting member that is hung, and a pair of support shaft holding members that hold both ends of the support shaft respectively and are rotatably attached to the printer, the method including fixing a part of the supporting member unwound from the winding unit to the printer, and, in a direction in which the printer discharges the medium after printing, placing the winding unit in such a way that the support shaft is interposed between the winding unit and a position where the part of the supporting member is fixed to the printer, so as to bring the supporting member unwound from the winding unit into a state of being hung at the support shaft that is positioned higher than the winding unit, and adjusting an angle of the support shaft holding member to change a position of the support shaft, thereby changing a posture of the supporting member at which the medium is loaded.

DESCRIPTION OF EXEMPLARY EMBODIMENTS

An exemplary embodiment of a medium processing apparatus will be described below with reference to the drawings. The medium processing apparatus includes a printer and a winding type stacker unit that is an example of a loading apparatus, and is configured by a user attaching the winding type stacker unit to the printer.

Configuration of Printer and Transport Path of Medium

Figure 1:
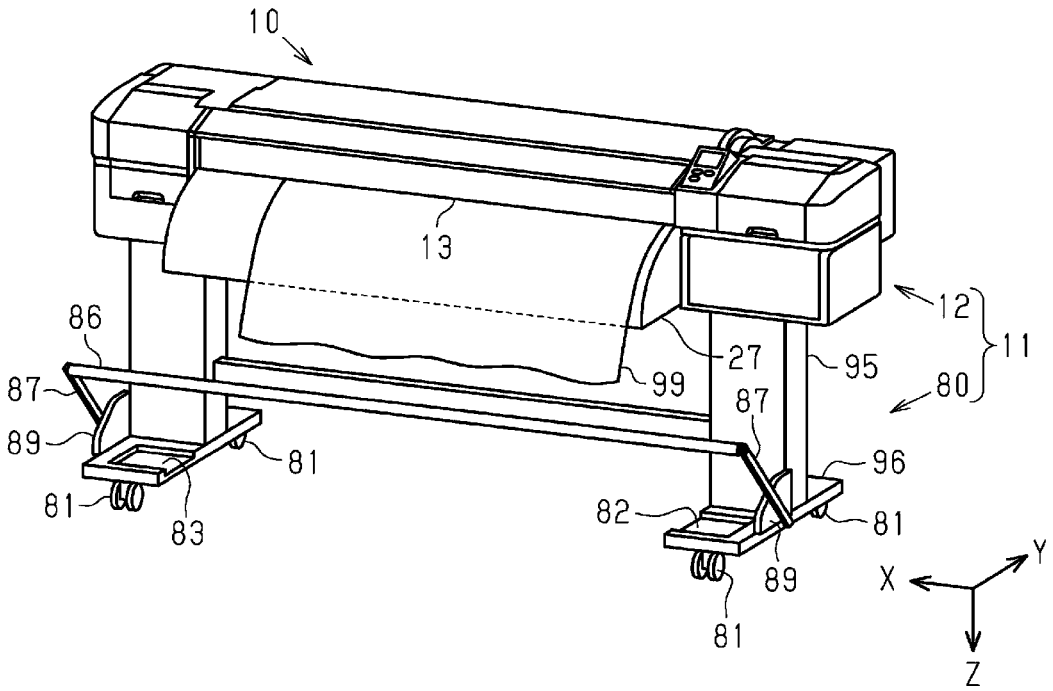
FIG. 1 is a perspective view illustrating a printer according to an exemplary embodiment.

As illustrated in FIG. 1, a printer 11 is, for example, an ink jet-type printer that prints characters and an image such as a photograph, by ejecting ink that is an example of liquid onto a medium such as a sheet. The printer 11 includes a housing 12, and a leg portion 80 that supports the housing 12. A front face of the housing 12 has a discharge port 13 as an example of a discharge unit for discharging a medium 99 on which printing is performed as an example of processing. A side of the printer 11 on which the discharge port 13 is present is referred to as a front of the printer 11, and an opposite side thereof is referred to as a rear of the printer 11.

The printer 11 has predetermined lengths as a width, a depth, and a height, in a state of being installed at a use location. Assuming that the printer 11 is installed on a horizontal plane, a direction of gravity is indicated by a Z-axis. At this time, a width direction and a depth direction of the printer 11 are substantially horizontal. The depth direction of the printer 11 is indicated by a Y-axis. The width direction of the printer 11 is indicated by an X-axis intersecting the Y-axis and the Z-axis. Thus, the X-axis, the Z-axis, and the Y-axis serve as coordinate axes indicating lengths of a width, a height, and a depth, respectively.

Figure 2:
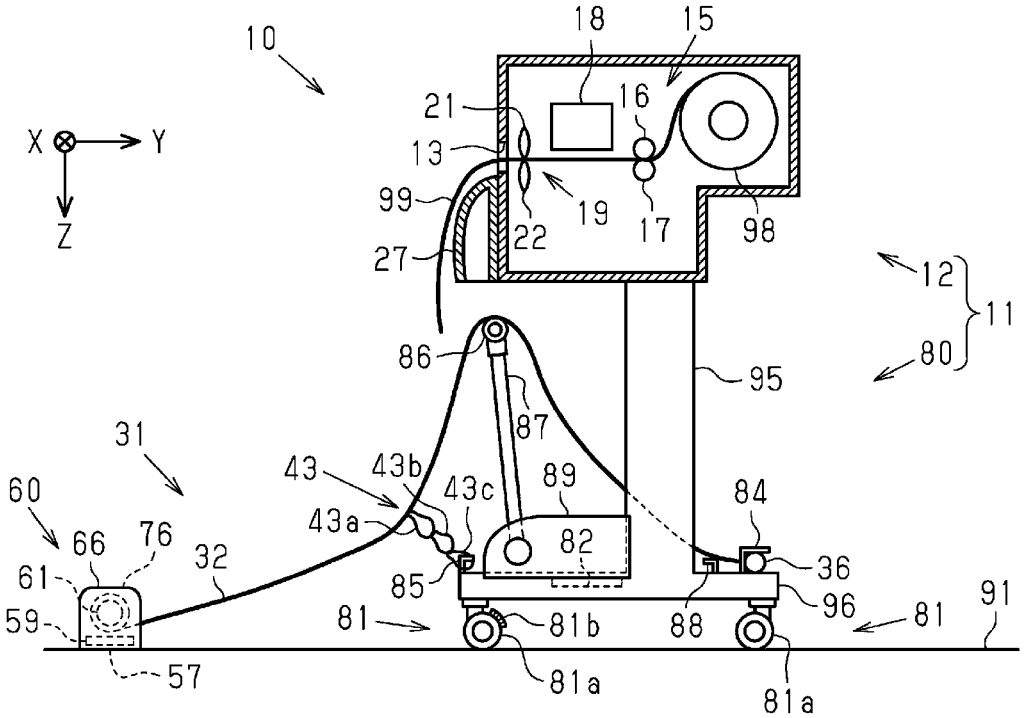
FIG. 2 is a side view illustrating the medium processing apparatus when the printer is in a forward discharge state.

As illustrated in FIG. 2, a roll body 98 around which the medium 99 is wound is housed at a predetermined position in the housing 12 of the printer 11.

As illustrated in FIG. 2, the printer 11 includes a transport unit 15 for transporting the medium 99 into the housing 12. The transport unit 15 includes a first roller 16 and a second roller 17. The first roller 16 and the second roller 17 rotate while sandwiching the medium 99, to transport the medium 99. The transport unit 15 transports the medium 99 from the roll body 98 toward the discharge port 13. In other words, the transport unit 15 transports the medium 99 in the housing 12, from the rear to the front of the housing 12.

The printer 11 includes a printing unit 18 for printing on the medium 99 in the housing 12. The printing unit 18 ejects liquid toward the medium 99, to print on the medium 99 transported by the transport unit 15.

The printer 11 includes a cutting unit 19 for cutting the medium 99 in the housing 12. The cutting unit 19 includes a first rotary blade 21 and a second rotary blade 22. The first rotary blade 21 and the second rotary blade 22 rotate while sandwiching the medium 99, to cut the medium 99. The medium 99 that is continuous from the roll body 98 and is long, is cut by the cutting unit 19 into the medium 99 that is a single-sheet separated from the roll body 98.

As illustrated in FIG. 2, the printer 11 includes a support shaft 86 and a support shaft holding member 87. Both ends of the support shaft 86 are held at tips of a pair of the support shaft holding members 87 respectively, and respective base ends of the pair of support shaft holding members 87 are rotatably attached to an angle adjustment member 89 of the leg portion 80. By setting the support shaft holding member 87 to a desired rotation angle, it is possible to change a position of the support shaft 86.

As illustrated in FIG. 2, a medium processing apparatus 10 includes the printer 11, and a winding type stacker unit 31 as an example of a loading apparatus. The winding type stacker unit 31 has a winding type configuration capable of winding a sheet-like supporting member 32. When the user attaches the supporting member 32 to the printer 11 in a state of being hung at the support shaft 86 as illustrated in FIG. 2, a part of the supporting member 32 is formed as a stacker that receives the medium 99 after printing discharged from the discharge port 13.

As illustrated in FIG. 2, the leg portion 80 of the printer 11 includes a pair of stands 95, and a pair of bases 96 that extend back and forth and on which respective lower ends of the pair of stands 95 are fixed. The leg portion 80 includes a plurality of rollers 81*a* that contact a surface at which the printer 11 is installed and are rotatable, and a locking levers 81*b* that is a locking member for regulating rotation of the roller 81*a*.

In the present exemplary embodiment, a total of four casters 81 are attached to the pair of bases 96 that constitute the leg portion 80, one for each of both end portions in a direction along the Y-axis. The caster 81 includes the roller 81*a* and the locking lever 81*b*. In the caster 81 on a − side in the Y-axis direction, rotation of the roller 81*a* can be locked by the locking lever 81*b*. The printer 11 is installed on a floor surface 91 by the four rollers 81*a*. When the locking lever 81*b* locks the roller 81*a*, the printer 11 cannot be moved, and when the lock is released, the printer 11 can be moved.

About Loading Apparatus

Figure 3:
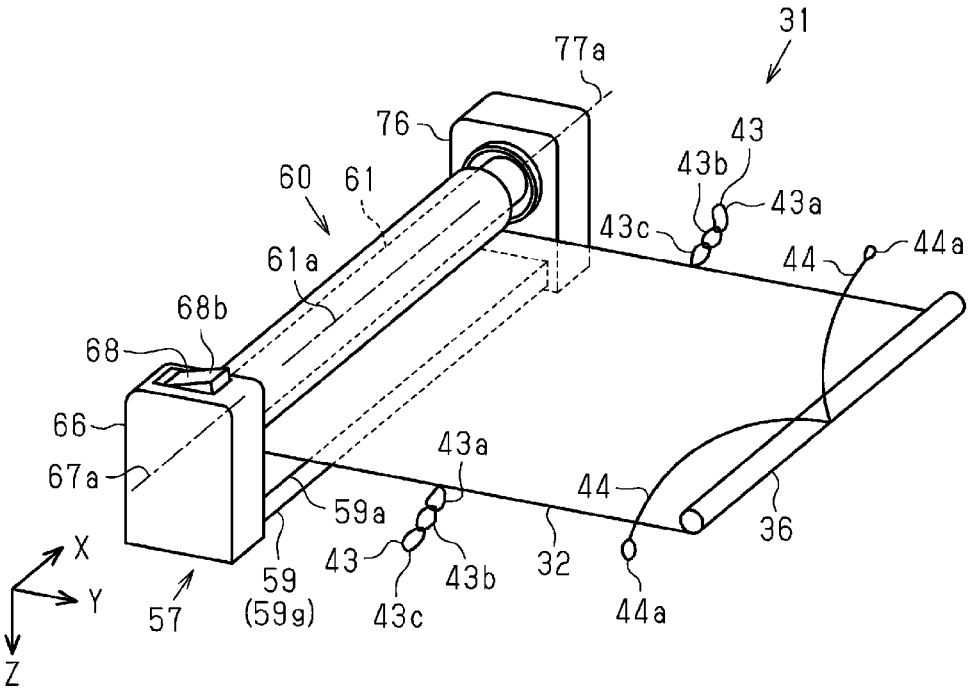
FIG. 3 is a perspective view illustrating a winding type stacker unit.

As illustrated in FIG. 3, the winding type stacker unit 31 (also simply referred to as the stacker unit 31 hereinafter) that is an example of a loading apparatus, is provided with the sheet-like supporting member 32 and a winding unit 60. The supporting member 32 is, for example, a long cloth constituted by a woven fabric, a nonwoven fabric, or the like, and has a rectangular shape. The supporting member 32 may be a sheet made of a synthetic resin. Examples of the synthetic resin include polyesters and the like, for example. In the present exemplary embodiment, an attachment shaft 36 is attached to a tip end portion of the supporting member 32 unwound from the winding unit 60. Note that, the attachment shaft 36 may be omitted.

The winding unit 60 includes a winding shaft 61 for winding the supporting member 32, and a first case 66 and a second case 76 that rotatably support both end portions of the winding shaft 61, respectively. One end of the supporting member 32 is fixed to the winding shaft 61, and another end (tip end) thereof is fixed to the attachment shaft 36. The supporting member 32 is wound around the winding shaft 61.

The winding unit 60 includes a coupling member 59 that couples the first case 66 and the second case 76 to each other. The first case 66 and the second case 76 are fixed to both ends of the coupling member 59 respectively that extends parallel to the winding shaft 61. The coupling member 59 is one rigid metal plate that does not twist itself. Thus, the coupling member 59 fixes the first case 66 and the second case 76 so as to be non-rotatable with respect to each other in a plane orthogonal to an axis line of the winding shaft 61.

As illustrated in FIG. 3, in the present exemplary embodiment, the coupling member 59 also serves as a guide member 59*g* that guides the supporting member 32. The guide member 59*g* has a straight portion 59*a* that, when the supporting member 32 is being wound by the winding shaft 61, contacts and guides the supporting member 32. The straight portion 59*a* extends linearly in an axial direction of the winding shaft 61, and has a convex shape in a cross section orthogonal to that axial direction. A length of the straight portion 59*a* is slightly longer than a length of the supporting member 32 in the axial direction of the winding shaft 61. When winding the supporting member 32, the user brings a surface (back surface) on a floor side of the supporting member 32 in contact with the straight portion 59*a* and winds the supporting member 32.

The convex shape, that is the shape of the cross-section of the straight portion 59*a*, includes a corner shape and a convex curved shape. An angle of a corner of the corner shape is not limited to a right angle, and may be an acute angle or an obtuse angle, or a tip end portion of the corner portion may have a roundness. The straight portion 59*a* of the present exemplary embodiment is a curved portion formed by performing a bending process for the guide member 59*g*. The tip end portion of the corner portion of the straight portion 59*a* is rounded by the bending process. A radius of curvature is a predetermined value within a range of 2 to 8 mm, for example. When the cross-sectional shape of the straight portion 59*a* is a convex curved shape, an arc shape and an elliptical arc shape are included. Note that, the radius of curvature may be a value outside the range of 2 to 8 mm.

When the winding shaft 61 rotates in a clockwise direction in FIG. 2, the supporting member 32 is wound around the winding shaft 61. When the winding shaft 61 rotates in a counterclockwise direction in FIG. 2, the supporting member 32 is unwound from the winding shaft 61. The supporting member 32 is used in a state of being unwound from the winding shaft 61 by a predetermined amount.

The supporting member 32 is formed as a roll by being wound around the winding shaft 61. As such, the stacker unit 31 is made compact in a state in which the supporting member 32 is wound in a roll shape around the winding shaft 61. The stacker unit 31 is placed at a predetermined position of the leg portion 80, and is compactly stored using a space below the housing 12 with respect to the printer 11. Thus, when the stacker unit 31 is not used, the medium processing apparatus 10 is made compact.

As illustrated in FIG. 3, a base end of two guide strings 44 is fixed to the attachment shaft 36. A fourth annular member 44*a* is attached to a tip of each of the two guide strings 44. By hooking the fourth annular member 44*a* to a hook (not illustrated) fixed to the leg portion 80 of the printer 11, an end portion on a side of the attachment shaft 36 of the supporting member 32 is fixed to the printer 11.

As illustrated in FIG. 2, the attachment shaft 36 is attached to an attachment portion 84 of the printer 11. The attachment portion 84 is set at a height position that is lower than a height position of the support shaft 86, when the support shaft holding member 87 is at a rotational angle slightly inclined forward from a vertical direction, such that the supporting member 32 lines a chevron path in a side view, with the supporting member 32 extending from the attachment shaft 36 being hung on the support shaft 86. In the present exemplary embodiment, the attachment of the attachment shaft 36 to the attachment portion 84, and the hooking of the guide string 44 on the hook fix a part of the supporting member 32 on a winding tip side to the printer 11.

As illustrated in FIG. 2, in a direction in which the printer 11 discharges the medium 99 after printing, the winding unit 60 is placed at a position on the floor surface 91 facing a position of a part (tip end portion) of the supporting member 32 fixed to the printer 11 by the attachment shaft 36 and the attachment portion 84, with the support shaft 86 interposed therebetween. The supporting member 32 unwound from the winding unit 60 is hooked on the support shaft 86 positioned higher than the winding unit 60 to take the chevron path in a side view in FIG. 2, and the tip end portion thereof is fixed to the printer 11 by the attachment shaft 36 being fixed to the attachment portion 84. Note that, in the present exemplary embodiment, the state in which the winding unit 60 is placed on the floor surface 91 is a state in which there are three or more contact points between the winding unit 60 and the floor surface 91, and a posture of the winding unit 60 is stable.

The attachment portion 84 is protrudingly provided upward from a rear upper surface of the base 96. The attachment portion 84 is constituted by a hook that can hook the attachment shaft 36, and facilitates attachment and removal of the winding type stacker unit 31 to and from the printer 11.

As illustrated in FIG. 3, the stacker unit 31 includes an adjuster 43 for pulling the supporting member 32. A pair of the adjusters 43 are attached to positions that are edge portions on both sides respectively, in a width direction of the supporting member 32. The pair of adjusters 43 are attached to edge portions on both the sides in the width direction respectively, at a position on a side of the winding shaft 61 separated by a predetermined distance from the attachment shaft 36 in a longitudinal direction of the supporting member 32. The adjuster 43 includes a first annular member 43*a*, a second annular member 43*b*, and a third annular member 43*c*. The adjuster 43 is constituted by a string having a plurality of rings made of an identical material to that of the supporting member 32, for example. In the present exemplary embodiment, the adjuster 43 is a string made of a synthetic resin, and thus, the supporting member 32 that is pulled through the adjuster 43, is given a rigid tension to a degree so as not to bounce due to a drop load when the medium 99 is received.

In FIG. 2, the adjuster 43 is fixed to a position in the middle of a part of the supporting member 32 hanging down between the support shaft 86 and the winding unit 60. The adjuster 43 is attached to a first placement portion 85 that is protrudingly provided upward from a front upper surface of the leg portion 80. In other words, a part hanging down from the support shaft 86 toward the winding unit 60 of the supporting member 32 is pulled diagonally downward via the adjuster 43, at a position halfway. The adjuster 43 is used to adjust an inclination angle of a part on which the medium 99 after printing is loaded, when the stacker is attached in a forward discharge state illustrated in FIG. 2.

The adjuster 43 is used to adjust the inclination angle of the part on which the medium 99 after printing is loaded. The inclination angle of the part of the supporting member 32 on which the medium 99 is loaded is substantially a right angle when the first annular member 43*a* is attached to the first placement portion 85. When the second annular member 43*b* is attached to the first placement portion 85, the inclination angle of the part of the supporting member 32 on which the medium 99 is loaded is slightly inclined to have a posture front-downward with respect to the vertical direction. When the third annular member 43*c* is attached to the first placement portion 85, the inclination angle of the part of the supporting member 32 on which the medium 99 is loaded is further inclined front-downward to a predetermined inclination angle.

As illustrated in FIG. 2 and FIG. 3, the winding unit 60 of the stacker unit 31 includes a placement portion 57 that, when the winding unit 60 is placed on a flat surface, contacts the flat surface. In other words, the placement portion 57, when the winding unit 60 is placed on a flat surface, includes three or more contact points between the winding unit 60 and the flat surface. The stacker unit 31 is placed on a floor surface on which the printer 11 is installed, for example. In the present exemplary embodiment, the placement portion 57 includes a bottom of each of the first case 66 and the second case 76. The stacker unit 31 is, by the placement portion 57 contacting the floor surface, placed on a floor surface with the winding shaft 61 held in a horizontal posture to the floor surface.

As illustrated in FIG. 2, the support shaft 86 is set at a position higher than the floor surface 91 and lower than the discharge port 13. Thus, the medium 99 cut by the cutting unit 19 is discharged from the discharge port 13, and after being transported along a discharge guide 27, slides down on the supporting member 32 inclined front-downward, and is loaded on a front portion of the supporting member 32. The supporting member 32 is pulled rear-downward via the pair of adjusters 43. Accordingly, in a part forward the support shaft 86, the inclination angle is larger in a first region between the support shaft 86 and the adjuster 43, and the inclination angle is smaller than the first region in a second region between the adjuster 43 and the winding shaft 61, and the supporting member 32 is inclined gently. Thus, the medium 99 slides down quickly along the first region, even when a tip end portion thereof is curled. For example, a configuration in which the inclination angle of the supporting member 32 is small is assumed. In this case, the curled medium 99 is caught in the middle of the supporting member 32, stops halfway without sliding down. In this case, the medium 99 precedent and stopped halfway blocks the discharge from the discharge port 13 and proper loading on the supporting member 32, for the medium 99 that follows.

Further, when changing the length of the supporting member 32 to match a length of the medium 99, the user moves the stacker unit 31. At this time, the user pulls the supporting member 32 in some cases. However, a part of the pulling force is received by the printer 11 via the adjuster 43 pulling the supporting member 32 rear-downward. Thus, the pulling force when the user pulls the supporting member 32 to move the stacker unit 31 is not easily transmitted to the support shaft 86. Even when the user pulls the supporting member 32 somewhat, position shift of the support shaft 86 is less likely to occur.

About Loading Form of Medium

Figure 4:
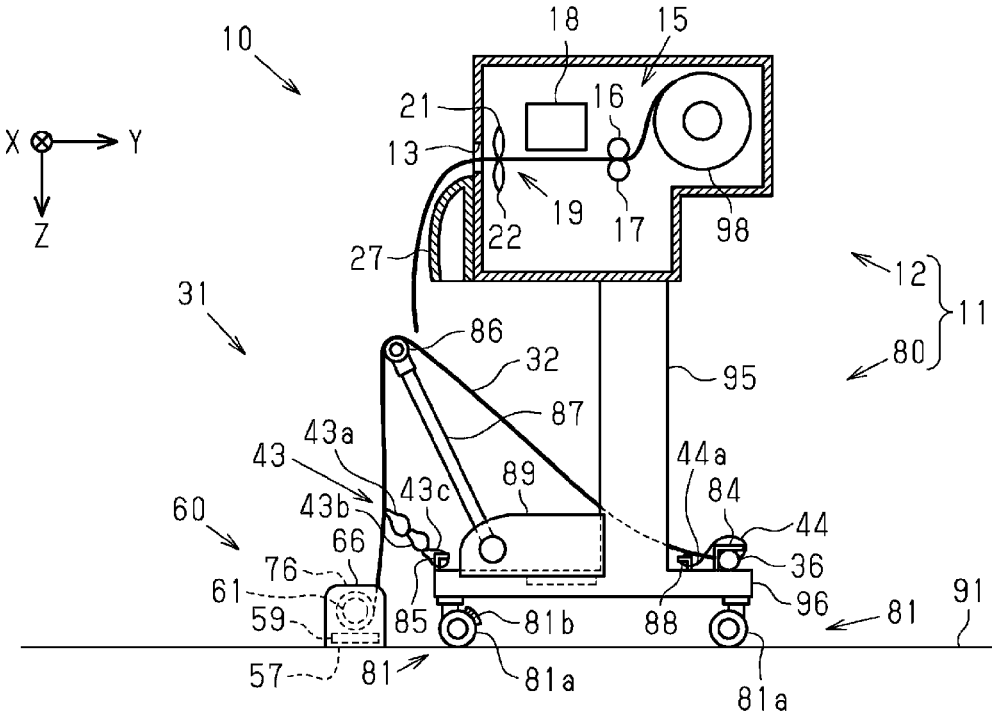
FIG. 4 is a side view illustrating the medium processing apparatus when the printer is in a rearward discharge state.

The medium processing apparatus 10 can switch between a forward discharge posture illustrated in FIG. 2 in which the medium 99 after printing discharged from the discharge port 13 is slid forward on the supporting member 32 and is received on the supporting member 32, and a rearward discharge posture illustrated in FIG. 4, in which the medium 99 after printing is slid rearward on an upper surface of the supporting member 32 and is received on the supporting member 32.

First, with reference to FIG. 2, a loading form when the stacker unit 31 is installed in the forward discharge posture will be described. As illustrated in FIG. 2, when the forward discharge posture is used, a position of the support shaft 86 is located rearward a medium transporting surface of the discharge guide 27. The winding unit 60 is placed at a position on the floor surface 91 separated forward from the printer 11 with the supporting member 32 being hung on the support shaft 86 from an upper side. A distance by which the winding unit 60 is separated forward from the printer 11 is determined depending on the length of the medium 99 to be cut after printing. The user adjusts a position of the placement of the winding unit 60 to match the length of the medium 99 to be discharged from the discharge port 13. Depending on an unwind amount of the supporting member 32 unwound from the winding shaft 61, a size of the medium 99 that can be loaded on the supporting member 32 changes. When the size of the medium 99 is large, the unwind amount of the supporting member 32 is increased. When the size of the medium 99 is small, the unwind amount of the supporting member 32 is decreased. The forward discharge posture is used mainly when the long medium 99 is loaded.

Since the medium 99 has a curled shape, depending on an angle at which a tip of the medium 99 discharged from the discharge port 13 hits the supporting member 32, there is a possibility that the medium 99 is loaded in a round shape. By adjusting the position of the support shaft 86 and pulling strength by the adjuster 43, the inclination angle of the supporting member 32 at a part where the tip of the medium 99 discharged from the discharge port 13 hits can be changed. By adjusting an angle of the support shaft holding member 87 to change the position of the support shaft 86, a posture of the supporting member 32 receiving the medium 99 is changed.

With the adjuster 43, the angle at which the tip of the medium 99 discharged from the discharge port 13 hits the supporting member 32 can be changed. The angle at which the tip of the medium 99 hits the supporting member 32 is gentle when the first annular member 43*a* is attached to the first placement portion 85, the angle is slightly steep when the second annular member 43*b* is attached to the first placement portion 85, and the angle is further steep when the third annular member 43*c* is attached to the first placement portion 85.

When the medium 99 is loaded on the supporting member 32 in the forward discharge posture, the medium 99 is loaded on the supporting member 32 in a posture in which a printed surface faces upward. The user can retrieve the medium 99 from the front of the printer 11. A back surface that is a surface opposite to the printed surface of the medium 99 contacts the supporting member 32. Since the printed surface does not contact the supporting member 32, quality of a printed image is less susceptible to placement of the medium 99 on the supporting member 32.

Next, with reference to FIG. 4, a loading form when the stacker unit 31 is attached in the rearward discharge posture will be described. As illustrated in FIG. 4, the support shaft 86 is adjusted to a position forward the medium transporting surface of the discharge guide 27. The winding unit 60 is placed on the floor surface 91 at a position near the front of the printer 11, with the supporting member 32 being hung on the support shaft 86 from the upper side. Since the support shaft 86 is positioned higher than the attachment shaft 36, a part of the supporting member 32 between the support shaft 86 and the attachment shaft 36 inclines rear-downward. The medium 99 discharged from the discharge port 13 slides rearward on the part of the supporting member 32 inclining rear-downward between the support shaft 86 and the attachment shaft 36, and is loaded on a rear end part of the supporting member 32. Adjustment of an inclination angle of the part inclining rear-downward of the supporting member 32 is performed by adjusting the unwind amount from the winding shaft 61, and adjusting the pulling strength by the adjuster 43.

Since the medium 99 has the curled shape, when the medium 99 discharged from the discharge port 13 slides down rearward on the upper surface of the supporting member 32, there is a possibility that the tip of the medium 99 exceeds a position of the attachment portion 84, and the medium 99 falls from the supporting member 32. By attaching the fourth annular member 44*a* of each of the two guide strings 44 to a second placement portion 88 protrudingly provided upward from the rear upper surface of the base 96 of the leg portion 80, the two guide strings 44 are stretched in a substantially V shape in a rear view. Thus, at a destination to which the medium 99 discharged from the discharge port 13 slides down rearward on the upper surface of the supporting member 32, the tip of the medium 99 hits the guide string 44 and stops. The guide string 44 that is used to fix the attachment shaft 36 to the base 96 in this manner, functions as a stopper for the medium 99. The guide string 44 prevents the medium 99 sliding down on the supporting member 32, from climbing over the attachment portion 84. Note that, the printer 11 may have a configuration in which the discharge guide 27 is not provided. In this case, in the forward discharge posture, the support shaft 86 is adjusted to a position rearward the discharge port 13, and in the rearward discharge posture, the support shaft 86 is adjusted to a position forward the discharge port 13.

About Rotation Mechanism

Figure 5A:
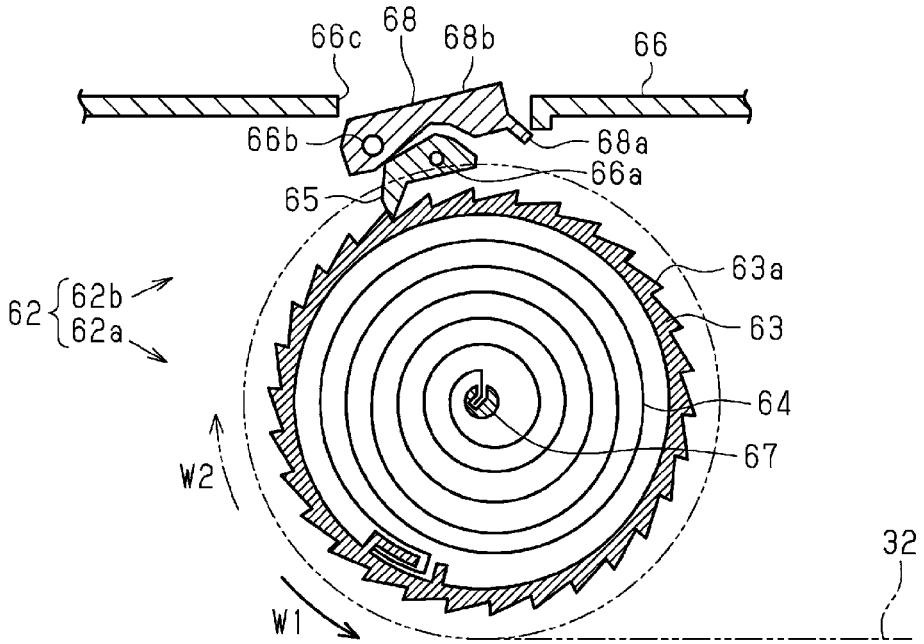
FIG. 5A is a schematic view explaining movement of a rotation mechanism.
Figure 5B:
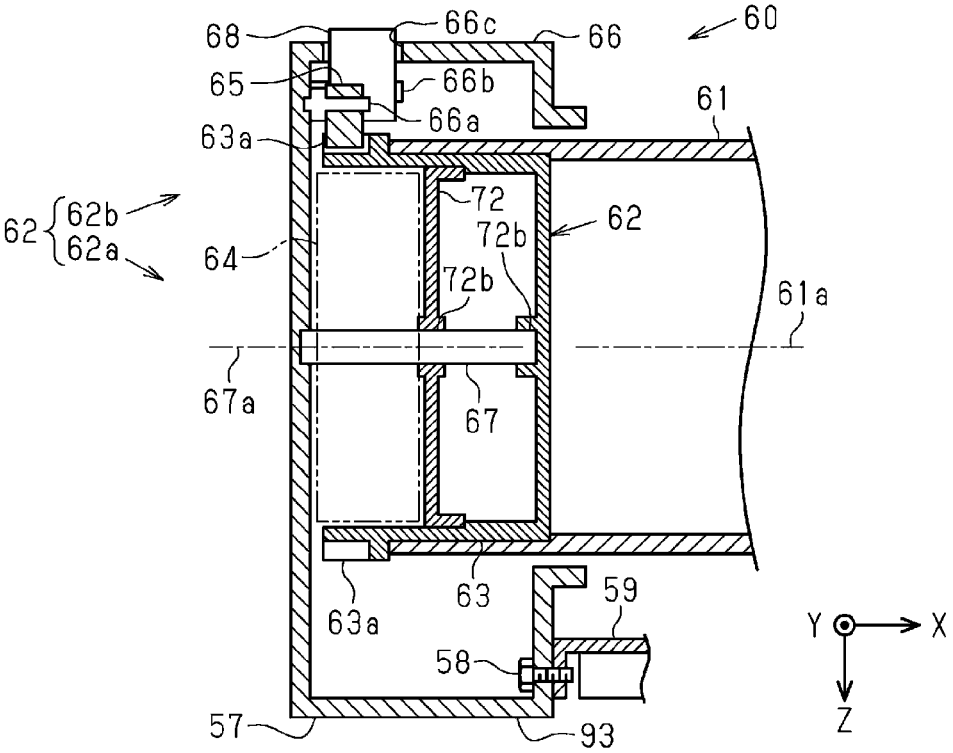
FIG. 5B is a schematic cross-sectional view illustrating an interior of a first case.
Figure 7A:
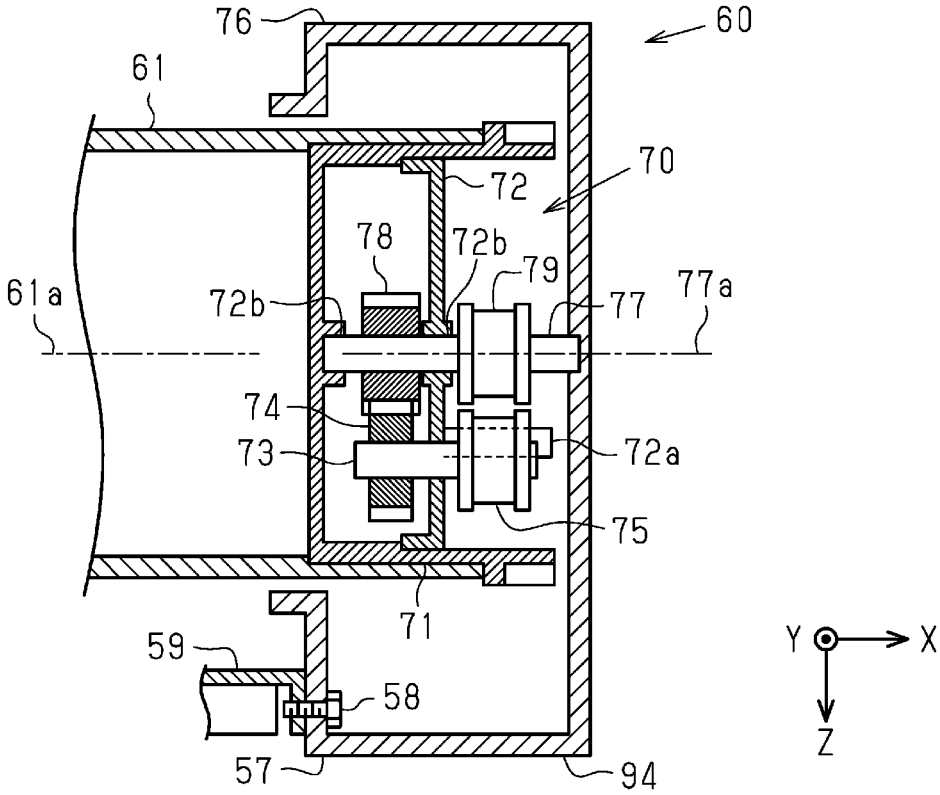
FIG. 7A is a schematic cross-sectional view illustrating an interior of a second case.

As illustrated in FIG. 5B and FIG. 7A, the winding shaft 61 has a long, thin, and cylindrical shape having a predetermined length, and an inside thereof is a cavity. A first mating member 63 and a second mating member 71 each having a bottomed cylindrical shape are mated to both end portions of the winding shaft 61, respectively. Thus, the winding shaft 61, the first mating member 63, and the second mating member 71 integrally rotate.

As illustrated in FIG. 5B, a part of the winding shaft 61 where the first mating member 63 is mated is housed in the first case 66. In a central part of the first case 66, a first main shaft 67 is disposed with an axis line thereof aligned with the winding shaft 61. In other words, a first main axis line 67*a* of the first main shaft 67 is aligned with a winding axis line 61*a* of the winding shaft 61, and one end portion of the first main shaft 67 is non-rotatably inserted into a support hole formed in an inner wall of the first case 66. For example, the first main shaft 67 is non-rotatably coupled to the inner wall of the first case 66, by inserting the one end portion having a polygonal prism shape of the first main shaft 67 into a support hole formed by a polygonal hole. A disk member 72 is mated to an inside of the first mating member 63, and is located at a central part in an axial direction of the first mating member 63. The first mating member 63 and the disk member 72 are integral and rotate around the first main shaft 67 via a bearing portion 72*b*. In other words, the winding shaft 61 rotates around the first main shaft 67 via the bearing portion 72*b*.

As illustrated in FIG. 5A and FIG. 5B, the winding unit 60 includes a rotation mechanism 62. The rotation mechanism 62 includes a winding mechanism 62*a* for rotating the winding shaft 61 in a winding direction, and a stop mechanism 62*b* for stopping a winding operation of the supporting member 32 by the winding mechanism 62*a* at an unwound position in the middle of unwinding of the supporting member 32. The rotation mechanism 62 is provided inside at least one of the first case 66 and the second case 76. In the present exemplary embodiment, the rotation mechanism 62 is provided inside the first case 66.

The winding mechanism 62*a* includes the first mating member 63 mated to the winding shaft 61, the disk member 72, and the first main shaft 67 that rotatably supports the first mating member 63 and the disk member 72 via the bearing portion 72*b*. In the present exemplary embodiment, the winding mechanism 62*a* includes a flat spiral spring 64 as an example of a drive unit and a rotary biasing portion. Additionally, the stop mechanism 62*b* is constituted by a ratchet gear 63*a* and a ratchet claw 65.

As illustrated in FIG. 5A, the flat spiral spring 64 is inserted inside the first mating member 63. An inner end portion of the flat spiral spring 64 is fixed to the first main shaft 67, and an outer end portion is fixed to a predetermined position on an inner circumferential surface of the first mating member 63.

In a state in which the supporting member 32 is wound around the winding shaft 61, the flat spiral spring 64 is in an unwound state. On the other hand, when the winding shaft 61 is rotated in an unwinding direction W1 indicated by an arrow in a counterclockwise direction in FIG. 5A, the flat spiral spring 64 is gradually wound. When the flat spiral spring 64 is wound, the flat spiral spring 64 tries to return to an original shape, and restoring force acts to rotate the first mating member 63 to an initial position before the flat spiral spring 64 is wound. In other words, the flat spiral spring 64 generates biasing force that causes the supporting member 32 to rotate the winding shaft 61 in a winding direction W2 indicated by an arrow in a clockwise direction in FIG. 5A.

As illustrated in FIG. 5A, the ratchet gear 63*a* is formed at an outer circumferential surface of the first mating member 63. The ratchet gear 63*a* is different from a usual gear, and all teeth thereof are each constituted by a triangular tooth inclined to one direction of a circumferential direction. A ratchet claw shaft 66*a* is disposed inside the first case 66, and the ratchet claw 65 is rotatably attached to the ratchet claw shaft 66*a*. An axis line of the ratchet claw shaft 66*a* is parallel to an axis line of the first mating member 63. The ratchet claw 65 is biased in the counterclockwise direction by a torsion coil spring (not illustrated). The ratchet claw 65 intermeshes with the ratchet gear 63*a*, by biasing force of the torsion coil spring.

When the first mating member 63 tries to rotate in the winding direction W2, the ratchet claw 65 digs into the tooth and regulates the rotation. On the other hand, when the first mating member 63 tries to rotate in the unwinding direction W1, the ratchet claw 65 climbs over the tooth to allow the rotation. In other words, the ratchet gear 63*a* and the ratchet claw 65 intermesh with each other to form a ratchet mechanism that allows the rotation of the winding shaft 61 in the unwinding direction W1 in which the supporting member 32 is unwound, and regulates the rotation of the winding shaft 61 in the winding direction W2 in which the supporting member 32 is wound.

As illustrated in FIG. 5A, the stop mechanism 62*b* can stop the winding shaft 61 in a first state in which the length of the supporting member 32 unwound from the winding unit 60 is a first unwind amount, and in a second state in which the length of the supporting member 32 unwound from the winding unit 60 is a second unwind amount greater than the first unwind amount. For example, in the present exemplary embodiment, the first state is illustrated in FIG. 4, the second state is illustrated in FIG. 2, and the second unwind amount in the second state is greater than the first unwind amount in the first state. Note that, the first state having the first unwind amount illustrated in FIG. 4 and the second state having the second unwind amount illustrated in FIG. 2 are merely an example. The stop mechanism 62*b* of the present exemplary embodiment can adjust the unwind amount of the supporting member 32 in a state in which the rotation of the winding shaft 61 in the winding direction W2 is stopped, in units of tooth pitch of the ratchet gear 63*a*.

As illustrated in FIG. 5A, of the first case 66 and the second case 76, the case provided with the rotation mechanism 62 is provided with an operation switch 68 that releases the stop of the winding shaft 61 by the stop mechanism 62*b*, to rotate the winding shaft 61 in the winding direction W2 by the restoring force of the flat spiral spring 64 that is the drive unit. In the present exemplary embodiment, the rotation mechanism 62 is provided in the first case 66. Additionally, the first case 66 is provided with the operation switch 68 that releases the stop of the winding shaft 61 by the stop mechanism 62*b* constituting the rotation mechanism 62, to rotate the winding shaft 61 by the restoring force of the flat spiral spring 64 that is the drive unit.

As illustrated in FIG. 5A, a switch shaft 66*b* is disposed inside the first case 66, and the operation switch 68 is rotatably attached to the switch shaft 66*b*. The operation switch 68 is biased in the counterclockwise direction in FIG. 5A by the torsion coil spring (not illustrated).

Figure 6A:
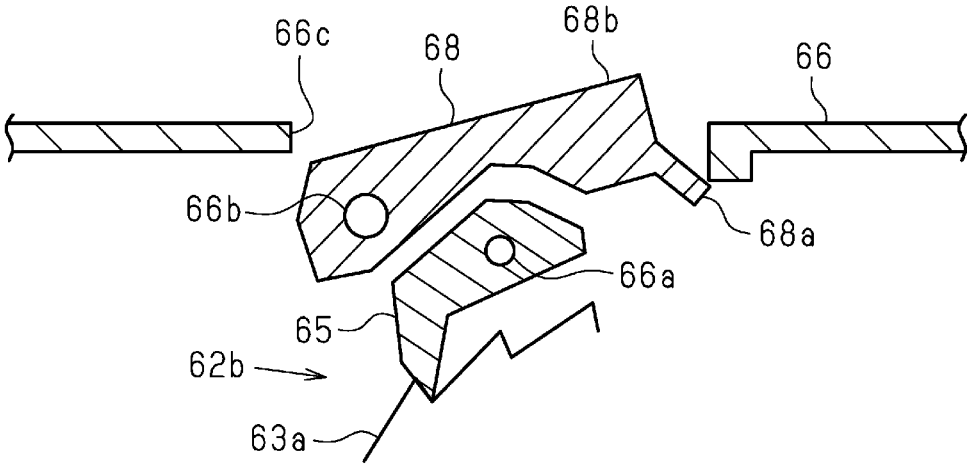
FIG. 6A is a schematic cross-sectional view illustrating a stop mechanism when an operation switch is in a non-operating position.

As illustrated in FIG. 6A, the operation switch 68 includes an operated portion 68*b* that is operated by the user. A part of the operation switch 68 protrudes outward an outer surface of the first case 66, from a hole 66*c* formed in the first case 66. The operation switch 68 stops in a state in which the regulating portion 68*a* of the operation switch 68 hits a part of the first case 66, by the biasing force of the torsion coil spring (not illustrated). In this state, the operation switch 68 is at a non-operating position at which the operated portion 68*b* protrudes outward the outer surface of the first case 66.

Figure 6B:
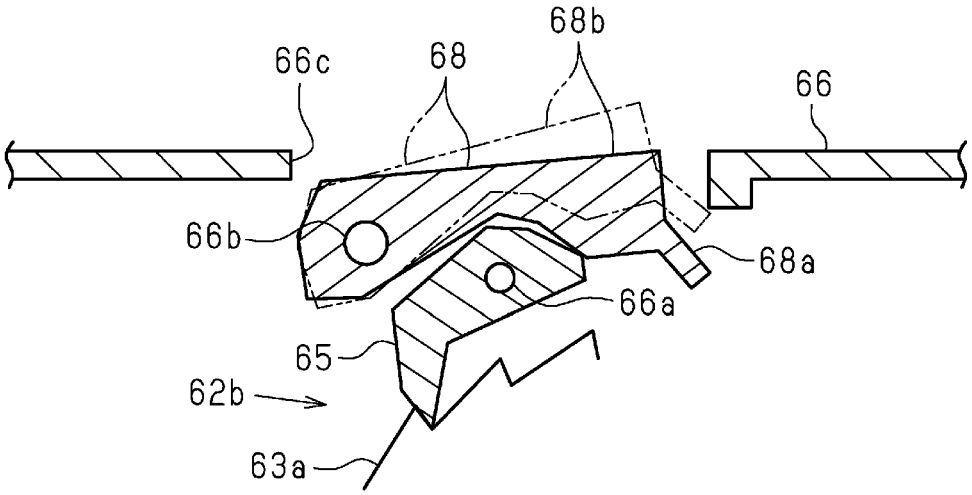
FIG. 6B is a schematic cross-sectional view explaining movement of the operation switch.

As illustrated in FIG. 6B, when the operated portion 68*b* of the operation switch 68 is pressed, the operation switch 68 rotates in a clockwise direction in the figure. As a result, the operation switch 68 is pushed down from the non-operating position indicated by a double dot chain line in FIG. 6B to a position at which the operated portion 68*b* is flush with the outer surface of the first case 66. In this state, the intermeshing between the ratchet claw 65 and the ratchet gear 63*a* is maintained. For example, even when, regardless of the user's intention, a part of body thereof, or an article such as a tool hits the operation switch 68 to push down the operation switch 68, the operated portion 68*b* is pressed at most to a position to be flush with the outer surface of the first case 66. In this case, the intermeshing between the ratchet claw 65 and the ratchet gear 63*a* is not released.

Figure 6C:
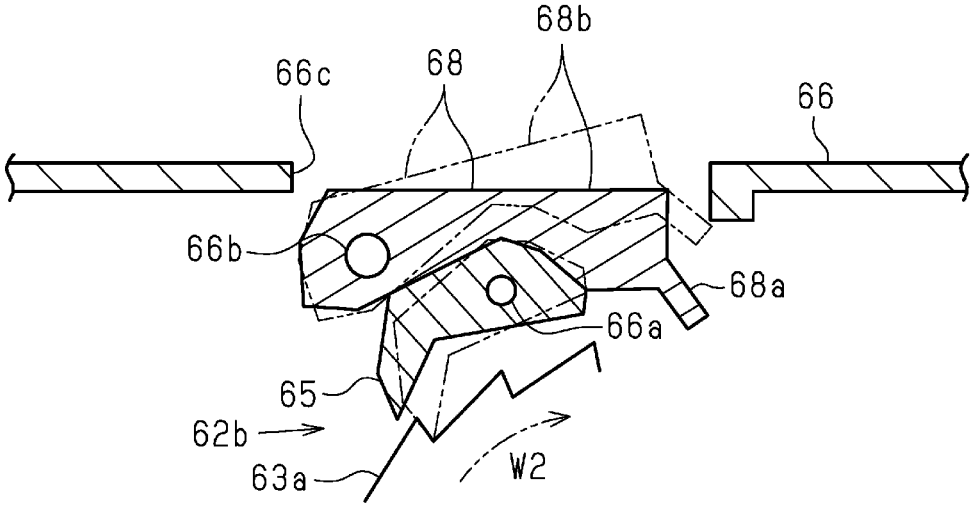
FIG. 6C is a schematic view illustrating the stop mechanism when the operation switch is at an operating position.

As illustrated in FIG. 6C, when the operated portion 68*b* of the operation switch 68 is further pushed down into an operating position located inward the first case 66, the operation switch 68 hits the ratchet claw 65. The ratchet claw 65 rotates in a clockwise direction in FIG. 6C, and the intermeshing between the ratchet claw 65 and ratchet gear 63*a* is released, thereby allowing rotation of the ratchet gear 63*a* in the clockwise direction. This allows rotation of the winding shaft 61 (see FIG. 5B) in the winding direction W2 in which the supporting member 32 is wound by the restoring force of the flat spiral spring 64. In other words, when the operated portion 68*b* is operated from the non-operating position protruding outward the outer surface of the first case 66 to the operating position located on an inner side of the first case 66 than the outer surface, the rotation mechanism 62 drives.

With the supporting member 32 unwound, when the user operates the operation switch 68 to bring into a state in which the ratchet claw 65 does not intermesh with the ratchet gear 63*a*, the first mating member 63 rotates in the winding direction W2 illustrated in FIG. 5A to return to an original position. Thus, the supporting member 32 is wound around the winding shaft 61.

About Unwind Amount Regulating Portion

As illustrated in FIG. 7A, an end portion of the winding shaft 61 to which the second mating member 71 is mated is housed in the second case 76. In a central part of the second case 76, a second main shaft 77 is disposed with an axis line thereof aligned with the winding shaft 61. In other words, a second main axis line 77*a* of the second main shaft 77 is aligned with the winding axis line 61*a* of the winding shaft 61, and one end portion of the second main shaft 77 is non-rotatably inserted into a support hole formed in an inner wall of the second case 76. The disk member 72 is mated to an inside of the second mating member 71, and is located at a central part in an axial direction of the second mating member 71. The second mating member 71 and the disk member 72 are integral and rotate around the second main shaft 77 via the bearing portion 72*b*. In other words, the winding shaft 61 rotates around the second main shaft 77 via the bearing portion 72*b*.

As illustrated in FIG. 7A, the winding unit 60 includes an unwind amount regulating portion 70 for regulating the unwind amount of the supporting member 32. The unwind amount regulating portion 70 is provided inside at least one of the first case 66 and the second case 76. In the present exemplary embodiment, the unwind amount regulating portion 70 is provided inside the second case 76. The end portion of the winding shaft 61 to which the second mating member 71 is mated is housed in the second case 76. The end portion of the winding shaft 61 is rotatably supported by the second case 76.

The unwind amount regulating portion 70 is constituted by the second main shaft 77 having a sun gear 78 and a sun pulley 79, a planetary gear 74, a planetary pulley 75, the disk member 72 for rotatably supporting the planetary pulley 75, and a rope 69.

As illustrated in FIG. 7A, on respective positions on both sides sandwiching the disk member 72 in the second main shaft 77, the sun gear 78 and the sun pulley 79 are mated to each other in a state in which respective axis lines are aligned with each other. Accordingly, the sun gear 78 and the sun pulley 79 are not rotatable with respect to the second case 76.

Figure 7B:
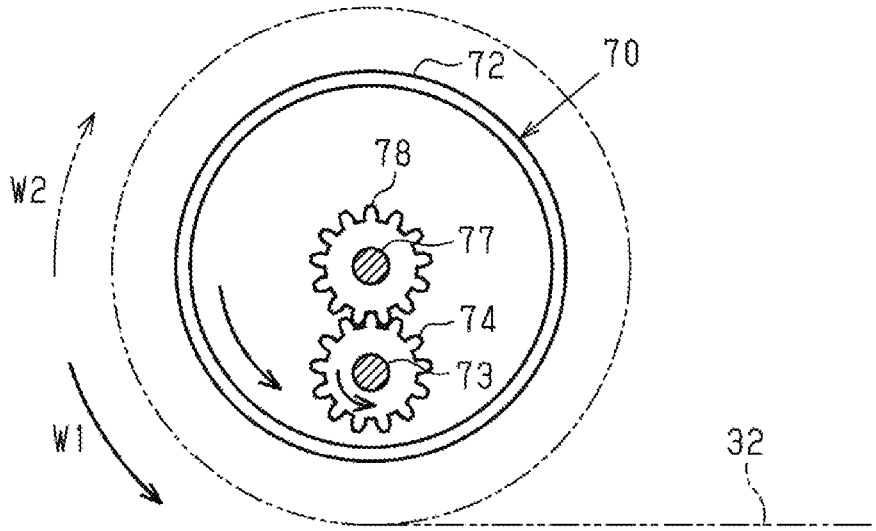
FIG. 7B is a schematic view explaining a planetary mechanism.

As illustrated in FIG. 7B, a planetary shaft 73 is rotatably attached to the disk member 72 at a position separated from the second main shaft 77 by a predetermined distance in a radial direction. On respective positions on both sides sandwiching the disk member 72 in the planetary shaft 73, the planetary gear 74 and the planetary pulley 75 are mated to each other in a state in which respective axis lines are aligned with each other. The planetary gear 74 intermeshes with the sun gear 78.

As illustrated in FIG. 7B, the sun gear 78 and the planetary gear 74 intermesh with each other, so as to configure a planetary gear mechanism in which, in association with rotation of the disk member 72 in the unwinding direction W1 indicated by an arrow in a counterclockwise direction in the figure, the planetary gear 74 rotates as a planet around the sun gear 78 in a direction indicated by an arrow in the counterclockwise direction in the figure.

The sun gear 78 and the planetary gear 74 are identical, for example, in the number of teeth. When the disk member 72 rotates once in the unwinding direction W1 indicated in the counterclockwise direction in FIG. 7B, the planetary gear 74 also rotates once as the planet in the counterclockwise direction in the figure. At this time, the planetary shaft 73, the planetary gear 74, and the planetary pulley 75 rotate integrally.

As illustrated in FIG. 7A, the sun pulley 79 and the planetary pulley 75 are disposed in respective directions such that axis lines thereof are parallel to each other, and are in a state in which mutual outer circumferential surfaces face each other. The sun pulley 79 and the planetary pulley 75 are identical in a width dimension that is a dimension in an axis line direction.

Figure 7C:
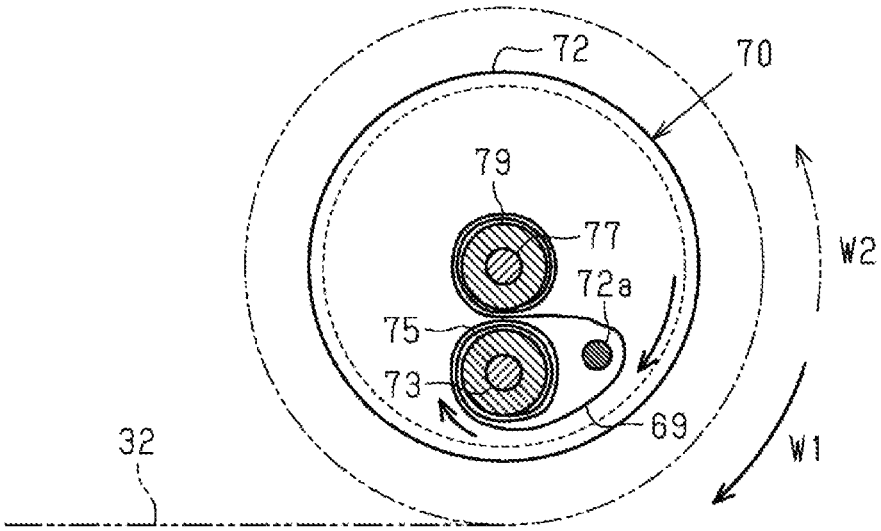
FIG. 7C is a schematic view explaining movement of an unwind amount regulating portion.

As illustrated in FIG. 7C, a regulating shaft 72*a* is protrudingly provided on a surface on a side of the disk member 72 on which the sun pulley 79 is disposed. As illustrated in FIG. 7C, when viewed from an axis line direction of the disk member 72, a center of the regulating shaft 72*a* is at a position that forms a regular triangle with a center of the second main shaft 77 and a center of the planetary shaft 73. The regulating shaft 72*a* is fixed to the disk member 72. The regulating shaft 72*a* protrudes slightly longer from the disk member 72 than the two pulleys 75 and 79.

As illustrated in FIG. 7C, one end of the rope 69 is fixed to a surface of a pulley portion of the sun pulley 79, and another end is fixed to a surface of a pulley portion of the planetary pulley 75. A winding direction of the rope 69 on the sun pulley 79 is a counterclockwise direction in FIG. 7C, and a winding direction of the rope 69 on the planetary pulley 75 is also the counterclockwise direction in FIG. 7C.

The rope 69 is hung on the regulating shaft 72*a*, and is given an allowance in a length of the rope of about one wind length of the pulley.

As illustrated in FIG. 7C, the sun pulley 79 and the planetary pulley 75 have an identical pulley diameter, and when the disk member 72 rotates once in the unwinding direction W1 indicated by an arrow in a clockwise direction in the figure, the rope 69 is unwound from the sun pulley 79 by one circumferential length. At this time, the planetary pulley 75 also rotates once in the clockwise direction indicated by the arrow in FIG. 7C, and the rope 69 is wound around the planetary pulley 75 by one circumferential length of the pulley diameter. In other words, an unwinding length and a winding length are substantially identical, and the rope 69 is gradually wound around the planetary pulley 75.

As illustrated in FIG. 7C, since the disk member 72 is mated to the second mating member 71, when the second mating member 71 rotates in the clockwise direction indicated by the arrow in the figure, the rope 69 is unwound from the sun pulley 79, and is wound around the planetary pulley 75. That is, when the winding shaft 61 rotates in the direction in which the supporting member 32 is unwound, the rope 69 is gradually unwound from the sun pulley 79, and is wound around the planetary pulley 75. When an entirety of the rope 69 wound around the sun pulley 79 is wound around the planetary pulley 75, the supporting member 32 is not unwound from the winding shaft 61 anymore. In other words, when an unwind amount exceeds a predetermined amount, the unwind amount regulating portion 70 regulates the rotation of the winding shaft 61 in the unwinding direction W1.

As illustrated in FIG. 7C, since the disk member 72 is mated to the second mating member 71, when the second mating member 71 rotates in the winding direction W2 that is a direction opposite to the unwinding direction W1 indicated by the arrow in the figure, the rope 69 is unwound from the planetary pulley 79, and is gradually wound around the sun pulley 75. That is, when the winding shaft 61 rotates in the winding direction W2 in which the supporting member 32 is wound, the rope 69 is unwound from the planetary pulley 75 and is wound around the sun pulley 79. When an entirety of the rope 69 wound around the planetary pulley 75 is wound around the sun pulley 79, the supporting member 32 is not wound from the winding shaft 61 anymore. In other words, when the unwind amount is smaller than a predetermined amount, the unwind amount regulating portion 70 regulates the rotation of the winding shaft 61 in the winding direction W2.

Next, installation structure of the stacker unit 31 will be described.

As illustrated in FIG. 5B, the first case 66 is fixed to one end of the coupling member 59, by a plurality of screws 58. In the present exemplary embodiment, the first case 66 is fixed to the one end of the coupling member 59 by a plurality of screws including the screw 58 illustrated in FIG. 5B. In other words, the first case 66 and the coupling member 59 are in a state of being held so as to be non-rotatably with respect to each other, in a plane orthogonal to the first main axis line 67*a* of the first main shaft 67 that is coincident with the winding axis line 61*a* of the winding shaft 61.

As illustrated in FIG. 7A, the second case 76 is fixed to another end of the coupling member 59, by the plurality of screws 58. In the present exemplary embodiment, the second case 76 is fixed to the other end of the coupling member 59 by a plurality of screws including the screw 58 illustrated in FIG. 7A. In other words, the second case 76 and the coupling member 59 are in a state of being held so as to be non-rotatably with respect to each other, in a plane orthogonal to the second main axis line 77*a* of the second main shaft 77 that is coincident with the winding axis line 61*a* of the winding shaft 61.

In the present exemplary embodiment, the winding shaft 61 performs axial rotation around the first main shaft 67 and the second main shaft 77 via the respective bearing portions 72*b* at both end portions thereof. With the first main axis line 67*a* of the first main shaft 67 supporting the winding shaft 61, and the second main axis line 77*a* of the second main shaft 77 being aligned with the winding axis line 61*a* of the winding shaft 61, the first case 66 and the second case 76 are fixed to both ends of the coupling member 59, respectively.

In other words, the first case 66 and the second case 76 are coupled via the coupling member 59, in a state in which the first main axis line 67*a* as an example of an axis line of the bearing portion 72*b* that supports the winding shaft 61, and the second main axis line 77*a* as an example of the axis line of the bearing portion 72*b* that supports the winding shaft 61 are aligned with each other, and in a state in which rotation in the plane orthogonal to the axis line of the winding shaft 61 is impossible.

The placement portion 57 includes a first installation surface 93 including a bottom of the first case 66 illustrated in FIG. 5B, and a second installation surface 94 including a bottom of the second case 76 illustrated in FIG. 7A. As illustrated in FIG. 5B, when the winding unit 60 is placed on a flat surface, the first installation surface 93 is in surface contact with the flat surface. The first installation surface 93 is a part corresponding to the first case 66 out of the placement portion 57 (see FIG. 2).

As illustrated in FIG. 7A, when the winding unit 60 is placed on a flat surface, the second installation surface 94 is in surface contact with the flat surface. The second installation surface 94 is a part corresponding to the second case 76 out of the placement portion 57 (see FIG. 2). As illustrated in FIG. 3, in a case in which the stacker unit 31 is installed on a flat surface such as the floor surface 91, when the first installation surface 93 (see FIG. 5B) contacts the flat surface, the second installation surface 94 (see FIG. 7A) contacts the flat surface. In the present exemplary embodiment, both the first installation surface 93 and the second installation surface 94 are in surface contact with an identical flat surface.

Figure 8:
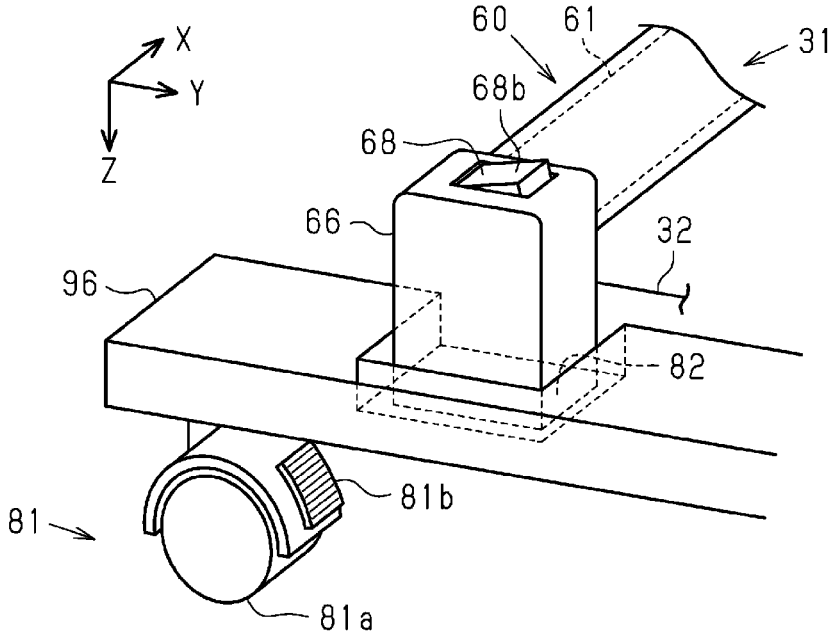
FIG. 8 is a perspective view illustrating a part of a leg portion of the printer.

As illustrated in FIG. 1 and FIG. 8, placement surfaces 82 and 83 on which the winding unit 60 is placed are provided on an upper portion of the leg portion 80. In other words, the first placement surface 82 on which the first case 66 of the stacker unit 31 is placed, and the second placement surface 83 on which the second case 76 (see FIG. 3) is placed are provided on the upper portion of the leg portion 80. When the printer 11 is not used, for example, the first installation surface 93 of the first case 66 is placed on the first placement surface 82, and the second placement surface 94 of the second case 76 is placed on the second placement surface 83 (see FIG. 1).

Next, action of the medium processing apparatus 10 will be described.

When using the stacker unit 31, the user attaches the supporting member 32 of the stacker unit 31 to the printer 11. Mainly, the supporting member 32 is attached in the two types of postures of the forward discharge posture and the rearward discharge posture. The user determines the posture of the supporting member 32 in consideration of a length and a type of the medium 99, printing quality, and the like.

As illustrated in FIG. 8, the user, when using the stacker unit 31, checks whether the roller 81*a* of the caster 81 of the base 96 is locked or not. When the roller 81*a* is not locked, the locking lever 81*b* is slid to lock the roller 81*a*.

As illustrated in FIG. 2, when the forward discharge posture in which the medium 99 is discharged forward the discharge port 13 is selected, the user increases the unwind amount of the supporting member 32, and moves the position of the support shaft 86 rearward the medium transporting surface of the discharge guide 27. The user brings the supporting member 32 into a state of being hung on the support shaft 86, and installs the winding unit 60 at a position far from the printer 11. The medium 99 is loaded on the supporting member 32 in a posture in which a printed surface faces upward.

As illustrated in FIG. 2, the user, without changing a positional relationship between the first case 66 and the second case 76 (see FIG. 3), in a state in which both the first installation surface 93 of the first case 66 and the second installation surface 94 of the second case 76 are in surface contact with the floor surface 91, can install the winding unit 60 at a position far from the printer 11.

As illustrated in FIG. 1 and FIG. 2, the user brings the first case 66 and the second case 76 to move the winding unit 60 in a direction separating away from the printer 11, in order to increase the unwind amount of the supporting member 32. At this time, since the winding unit 60 is pulled in the direction separating away from the printer 11, the supporting member 32 is unwound from the winding unit 60. When the supporting member 32 is unwound by a desired length, the winding unit 60 is placed on the floor surface 91.

On the other hand, as illustrated in FIG. 4, when the posture is changed to the rearward discharge posture in which the medium 99 is discharged rearward the discharge port 13, the user decreases the unwind amount of the supporting member 32, moves the position of the support shaft 86 forward the medium transporting surface of the discharge guide 27, and installs the winding unit 60 at a position close to the printer 11. The supporting member 32 inclines so as to descend while approaching rearward between the support shaft 86 and the attachment shaft 36. The medium 99 discharged from the discharge port 13 is, in a posture in which a printed surface faces downward, discharged rearward along the supporting member 32, and is loaded on the supporting member 32 at a position below the housing 12.

As illustrated in FIG. 4, the user, without changing the positional relationship between the first case 66 and the second case 76, in the state in which both the first installation surface 93 of the first case 66 and the second installation surface 94 of the second case 76 are in surface contact with the floor surface 91, installs the winding unit 60 at a position close to the printer 11. Thus, when in the rearward discharge posture illustrated in FIG. 4, the stacker unit 31 does not occupy a space as much.

As illustrated in FIG. 3, the first case 66 and the second case 76 are held so as to be non-rotatable with respect to each other via the coupling member 59, in a plane orthogonal to the winding axis line 61*a* of the winding shaft 61. The user can increase the unwind amount of the supporting member 32, without causing twisting of the winding shaft 61. When twisting of the winding shaft 61 occurs, a load when the user unwinds the supporting member 32 increases, and there is a possibility that the supporting member 32 cannot be unwound by force of the user.

In the present exemplary embodiment, as illustrated in FIG. 5B, the rotation mechanism 62 is inside the first case 66, and as illustrated in FIG. 7A, the unwind amount regulating portion 70 is inside the second case 76. For example, assume a configuration in which displacement is allowed in which the first case 66 and the second case 76 rotate in the plane orthogonal to the winding axis line 61*a* of the winding shaft 61. In this assumed configuration, this rotational displacement causes loosening of winding for the supporting member 32 on a side of the first case 66 on which the rotation mechanism 62 is present, although an intermeshing position between the ratchet claw 65 and the ratchet gear 63*a* does not change. The supporting member 32 on the side of the first case 66 on which the rotation mechanism 62 is present is unwound. The supporting member 32 in the second case 76 including the unwind amount regulating portion 70, is not unwound due to static friction force of the amount of winding regulating unit 70. Twisting of the winding shaft 61 occurs, and the winding axis line 61*a* of the winding shaft 61 inclines with respect to the X-axis. When an unwinding operation is started from this state, the supporting member 32 is unwound diagonally, so the load when the user unwinds the supporting member 32 increases.

Compared to this, in the stacker unit 31 of the present exemplary embodiment, as illustrated in FIG. 3, the first case 66 and the second case 76 are fixed to each other via the rigid coupling member 59. Thus, the first case 66 and the second case 76 are held in a state in which the first main axis line 67*a* and the second main axis line 77*a* are aligned with each other, that are axis lines of the respective bearing portions 72*b* supporting the winding shaft 61. As a result, the displacement is inhibited in which the first case 66 and the second case 76 rotate in the plane orthogonal to the winding axis line 61*a* of the winding shaft 61, and twisting does not occur in the winding shaft 61. Thus, when the unwinding operation is started, the supporting member 32 is not diagonally unwound, and the user can unwind the supporting member 32 with a small load.

In addition, in a state in which the winding unit 60 is placed on the floor surface 91, particularly when the supporting member 32 is in the forward discharge posture illustrated in FIG. 2, the winding unit 60 receives force in a direction toward the printer 11 due to tension of the supporting member 32. Then, the tension of the supporting member 32 increases as the number of media 99 loaded on the supporting member 32 increases. However, since the first case 66 and the second case 76 are fixed to each other via the rigid coupling member 59, the first case 66 and the second case 76 do not incline about the Z-axis. Thus, in the state in which the winding unit 60 is placed on the floor surface 91, wrenching of the winding shaft 61 is not caused.

Further, for example, due to weight of the supporting member 32, force in a direction in which the first case 66 overturns in a counterclockwise direction with respect to the Y-axis, and force in a direction in which the second case 76 overturns in a clockwise direction with respect to the Y-axis, act on the winding shaft 61. In other words, the force acts on the first case 66 and the second case 76 such that upper portions thereof overturn so as to approach each other about the Y-axis. However, since the first case 66 and the second case 76 are fixed to each other via the rigid coupling member 59, the first case 66 and the second case 76 do not incline about the Y-axis, due to the weight of the supporting member 32. Thus, in the state in which the user places the winding unit 60 on the floor surface 91, the user does not cause excessive wrenching of the winding shaft 61 in parts that support both ends of the winding shaft 61 respectively.

In addition, in an adjustment operation for the unwind amount of the supporting member 32, or the like, when the supporting member 32 is pulled, force to incline about the Z-axis is applied to the first case 66 and the second case 76. However, since the first case 66 and the second case 76 are fixed to the coupling member 59, even when the supporting member 32 is pulled, the cases do not incline about the Z-axis. As a result, when the supporting member 32 is pulled, excessive wrenching force is not caused in the parts that support both the ends of the winding shaft 61 respectively.

When wrenching of the winding shaft 61 occurs, a rotational load on the winding shaft 61 increases when the user unwinds the supporting member 32. When the wrenching of the winding shaft 61 is large, the first case 66 inclines with respect to the winding shaft 61, thereby causing distortion in the rotation mechanism 62 (see FIG. 5A) and increasing the rotational load. When the second case 76 inclines with respect to the winding shaft 61, distortion occurs in the unwind amount regulating portion 70 (see FIG. 7A), and the rotational load increases. When the rotational load increases, there is a possibility that the user cannot unwind the supporting member 32 smoothly.

When wrenching of the winding shaft 61 occurs, a rotational load on the winding shaft 61 increases when the user winds the supporting member 32. When the wrenching is large, the first case 66 inclines with respect to the winding shaft 61, thereby causing distortion in the rotation mechanism 62 (see FIG. 5B) and increasing the rotational load. When the second case 76 inclines with respect to the winding shaft 61, distortion occurs in the unwind amount regulating portion 70 (see FIG. 7A), and the rotational load further increases. When a load when the flat spiral spring 64 (see FIG. 5A) winds the supporting member 32 increases, there is a possibility that the supporting member 32 cannot be smoothly wound due to biasing force of the flat spiral spring 64. In addition, when wrenching occurs in the winding shaft 61, the first main axis line 67*a* (see FIG. 5B) and the second main axis line 77*a* (see FIG. 7A) intersect with the winding axis line 61*a* of the winding shaft 61, thus a part or an entirety of the winding shaft 61 inappropriately rotates in some cases, for example, eccentrically rotates. In this case, there is a possibility that wrinkles occur in the supporting member 32 wound.

As illustrated in FIG. 3, since the first case 66 and the second case 76 are fixed to each other via the rigid coupling member 59, when the winding unit 60 is installed on a flat surface such as the floor surface 91, both the first installation surface 93 (see FIG. 5B) and the second installation surface 94 (see FIG. 7A) are in surface contact with the flat surface. Accordingly, the winding unit 60 is placed in a stable horizontal posture on the floor surface 91 without rattling on the floor surface 91. Thus, by placing the winding unit 60 on the floor surface 91, a positional relationship between the first case 66 and the second case 76 does not change. Thus, when the winding unit 60 is placed on the floor surface 91, twisting and wrenching of the winding shaft 61 due to a contact state between the placement portion 57 of the winding unit 60 and the floor surface 91 do not occur.

As illustrated in FIG. 2, an angle of the support shaft holding member 87 supporting the support shaft 86 is an angle close to a right angle. By attaching the adjuster 43 to the first placement portion 85, an angle of the supporting member 32 forms a first inclination angle such that an inclination angle with respect to a horizon is large between the support shaft 86 and the adjuster 43, and forms a second inclination angle smaller than the first inclination angle with respect to the horizon between the adjuster 43 and the winding shaft 61. In other words, the supporting member 32 inclines so as to descend while approaching forward at the large inclination angle between the support shaft 86 and the adjuster 43, and inclines so as to descend while approaching forward at the gentle inclination angle between the adjuster 43 and the winding shaft 61.

As illustrated in FIG. 2, there is a case in which the user, for the purpose of changing, adjusting, and the like, of the posture of the supporting member 32, moves the winding unit 60 by a necessary distance, or winds the supporting member 32 around the winding shaft 61 by a desired amount. In this case, the user brings the first case 66 and the second case 76 to move the winding unit 60 in a direction away from the printer 11 at a low position, or operates the operation switch 68 to wind the supporting member 32 around the winding shaft 61. At this time, the supporting member 32 is pulled in the direction away from the printer 11. Tensile force when the supporting member 32 is pulled is primarily received by the adjuster 43 because of the aforementioned inclined posture of the supporting member 32. As a result, even when the supporting member 32 is pulled from a side of the winding unit 60, the position of the support shaft 86 is less likely to move.

In particular, for the support shaft holding member 87 holding the support shaft 86, angle adjustment in multiple stages is possible by a stopper function of the angle adjustment member 89 provided on the leg portion 80. However, when external force exceeding holding force of the stopper is applied, the support shaft holding member 87 comes off from the stopper that holds the support shaft holding member 87 at that time, and the position of the support shaft 86 is shifted or the support shaft 86 overturns. In the stacker unit 31 of the present exemplary embodiment, the pulling force acting on the supporting member 32 is mainly received by the leg portion 80 via the adjuster 43. Accordingly, the pulling force that the support shaft 86 receives from the supporting member 32 is suppressed to be small, and a direction of the pulling force faces is a nearly downward direction that is different from a rotation direction of the support shaft 86, thus position shift or overturning of the support shaft 86 is unlikely to occur.

As illustrated in FIG. 2 and FIG. 4, in the present exemplary embodiment, the supporting member 32 is unwound from a lower side of the winding shaft 61. As compared to a case in which the supporting member 32 is unwound from an upper side of the winding shaft 61, when the user moves the winding unit 60, or winds the supporting member 32, a start point for pulling the supporting member 32 is at a low position, thus the position of the support shaft 86 is less likely to move.

As illustrated in FIG. 5A, when a trial is made to pull the supporting member 32 with respect to the winding shaft 61, force is applied for rotating the winding shaft 61 in the unwinding direction W1. Then the ratchet claw 65 climbs over the tooth of the ratchet gear 63*a* and rotation is allowed. Thus, by pulling the supporting member 32 with respect to the winding shaft 61, the user can rotate the winding shaft 61 in the unwinding direction W1, to unwind the supporting member 32.

As illustrated in FIG. 7C, when the winding shaft 61 (see FIG. 7A) rotates in the unwinding direction W1 in which the supporting member 32 is unwound, the rope 69 is gradually unwound from the sun pulley 79 and wound around the planetary pulley 75. When the planetary pulley 75 winds the rope 69 completely, the user will not be able to unwind the supporting member 32 anymore.

As illustrated in FIG. 7C, when the winding shaft 61 (see FIG. 7A) rotates in the winding direction W2 in which the supporting member 32 is wound, the rope 69 is gradually wound from the planetary pulley 75 around the sun pulley 79. When the sun pulley 79 winds the rope 69 completely, the user will not be able to wind the supporting member 32 anymore.

As illustrated in FIG. 5B, the rotation mechanism 62 is inside the first case 66, and there is no part exposed to an outside, even during an operation by the user for unwinding the supporting member 32. Since the first case 66 covers an opposite side of a part to which the winding shaft 61 is mated in the first mating member 63, foreign matter is less likely to flow into the rotation mechanism 62. Thus, malfunction of the rotation mechanism 62 due to foreign matter is prevented.

Additionally, as illustrated in FIG. 7A, the unwind amount regulating portion 70 is inside the second case 76, and there is no part exposed to an outside, even during an operation by the user for unwinding the supporting member 32. since the second case 76 covers an opposite side of a part to which the winding shaft 61 is mated in the second mating member 71 that configures the unwind amount regulating portion 70, foreign matter is less likely to flow into the winding amount restricting portion 70. Thus, malfunction of the unwind amount regulating portion 70 due to foreign matter is prevented.

Figure 9:
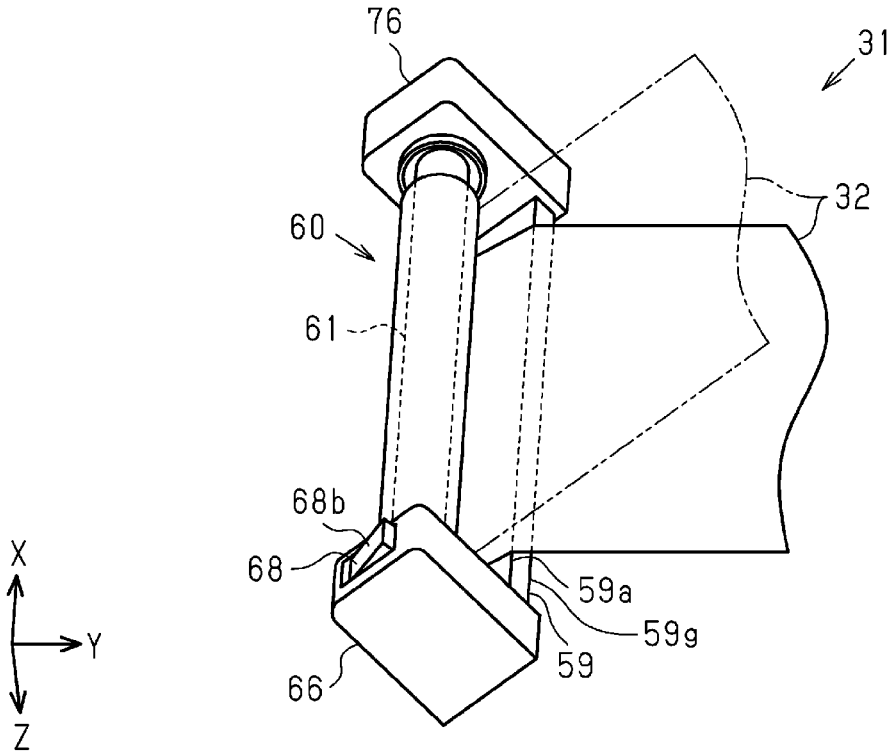
FIG. 9 is a perspective view when a winding unit is winding a supporting member.

As illustrated in FIG. 9, when the supporting member 32 is wound around the winding shaft 61, the user slightly inclines the first case 66 and the second case 76 with respect to a floor, and brings a back surface of the supporting member 32 into contact with the straight portion 59*a* of the guide member 59*g*. Then, the winding shaft 61 is rotated in the winding direction W2, while a state is maintained in which the back surface of the supporting member 32 is in contact with the straight portion 59*a*. In addition, when a winding amount is large, the user pushes down the operation switch 68 from the non-operating position to the operating position, with the back surface of the supporting member 32 in contact with the straight portion 59*a*. Then, the ratchet claw disengages from the tooth of the ratchet gear, and a stop function by the stop mechanism 62*b* is released, thereby rotating the winding shaft 61 in the winding direction W2 due to the restoring force of the flat spiral spring 64. As a result, the user can wind the supporting member 32 around the winding shaft 61, without manually rotating the winding shaft 61.

For example, once ending use of the stacker unit 31, the user removes the attachment shaft 36 from the attachment portion 84, removes the supporting member 32 from the support shaft 86, and spreads the supporting member 32 and places on the floor surface. As illustrated in FIG. 9, the user can cause automatic winding of the supporting member 32, by slightly inclining the winding unit 60, and bringing the back surface of the supporting member 32 into a state of being in contact with the straight portion 59*a*, and pushing down the operation switch 68. At this time, by operating the operation switch 68 little by little, winding speed of the supporting member 32 can be adjusted. In this winding process, a fold is formed in the supporting member 32 extending in a width direction at a site thereof contacting the straight portion 59*a*. That is, since this fold is formed, even if there is a wavy wrinkle in the width direction in the supporting member 32, that wrinkle is eliminated by the fold formed in a part of the straight portion 59*a* and extending in the width direction. As a result, the supporting member 32 can be wound in a state in which no wrinkle is formed.

As illustrated in FIG. 6C, when the user, in order to reduce the unwind amount of the supporting member 32, operates the operated portion 68*b* of the operation switch 68 from the non-operating position protruding outward the outer surface of the first case 66 to the operating position located on the inner side of the first case 66 than the outer surface of the first case 66, rotation of the winding shaft 61 in the direction in which the supporting member 32 is wound is allowed. When the user operates the operation switch 68 with an intention of winding the supporting member 32, the ratchet claw 65 disengages from the ratchet gear 63*a* in the stop mechanism 62*b*, and the winding shaft 61 is driven by the biasing force of the flat spiral spring 64.

As illustrated in FIG. 6B, even when a part of the operation switch 68 protruding outward the outer surface of the first case 66 is pushed down so as not to protrude outward the outer surface of the first case 66, the rotation of the winding shaft 61 in the direction in which the supporting member 32 is wound is not allowed. In other words, unless the operated portion 68*b* of the operation switch 68 is operated from the non-operating position protruding outward the outer surface of the first case 66 to the operating position located on the inner side of the first case 66 than the outer surface of the first case 66, the stop mechanism 62*b* illustrated in FIG. 5A and FIG. 6B is not released, and the rotation of the winding shaft 61 in the winding direction W2 in which the supporting member 32 is wound is not allowed. For example, even when the operation switch 68 is pressed against the user's intent, for example, when a person's foot hits the operation switch 68, or when the winding unit 60 is accidentally overturned and the operation switch 68 is pressed, the stop mechanism 62*b* is not released. Thus, it is possible to prevent the winding mechanism 62*a* from being driven, when the operation switch 68 is pressed against the user's intent.

As illustrated in FIG. 5A, when the stop mechanism 62*b* is released by operation of the operation switch 68, the winding shaft 61 rotates in the winding direction W2 in which the supporting member 32 is wound, due to the biasing force of the flat spiral spring 64. Since the flat spiral spring 64 rotates the winding shaft 61 in the winding direction W2 by the biasing force thereof, it is not necessary for the user itself to rotate the winding shaft 61 to wind the supporting member 32.

In the state illustrated in FIG. 2 and FIG. 4, when changing or adjusting the posture of the supporting member 32, or when winding the supporting member 32 with the end of use of the stacker unit 31, the user operates the operation switch 68 in some cases. At this time, even when the printer 11 is pulled via the supporting member 32 when the supporting member 32 is wound, by the biasing force of the flat spiral spring 64 (see FIG. 5A), since the roller 81*a* of the base 96 is locked, the printer 11 does not move.

After the end of use of the stacker unit 31, the user removes the adjuster 43, the attachment shaft 36, and the guide string 44 from the printer 11, and in the manner illustrated in FIG. 9, inclines the posture of the winding unit 60, and in a state in which the back surface of the supporting member 32 is brought into contact with the straight portion 59*a* of the guide member 59*g* to form a fold, winds the supporting member 32 around the winding shaft 61. Then, by placing the stacker unit 31 after completion of winding on the placement surfaces 82 and 83 provided on the base 96 of the leg portion, the stacker unit 31 is housed in a space below the housing 12 of the printer 11. As a result, the stacker unit 31 can be housed compactly with respect to the printer 11.

According to the exemplary embodiment described above, the following advantages are achieved.

(1) The stop mechanism 62*b* constituting the rotation mechanism 62 stops the winding shaft 61, in the first state in which the unwind amount is the first unwind amount, and in the second state in which the unwind amount is the second unwind amount that is greater than the first unwind amount. Thus, the unwinding length of the supporting member 32 is adjusted in accordance with the length of the medium 99, and additionally, the supporting member 32 can be maintained at the adjusted length. Thus, the supporting member 32 from a part fixed to the printer 11 to the winding shaft 61 can be held in a desired posture suitable for loading the medium 99 to be discharged. Additionally, the winding unit 60 is placed on a flat surface such as the floor surface 91. Thus, compared to the configuration described in JP-A-2017-65842, in which the winding shaft is supported by, for example, the pair of rotatable side rods, and the like, there is no concern about mutual position shift between the first case 66 and the second case 76. In a state in which the winding unit 60 is placed on a flat surface by the placement portion 57, for example, the first case 66 and the second case 76 are held so as to be non-rotatable with respect to each other in the plane orthogonal to the winding axis line 61*a* of the winding shaft 61. Accordingly, twisting of the winding shaft 61 is unlikely to occur. Additionally, for example, the first case 66 and the second case 76 are held so as to be non-rotatable with respect to each other in a state in which the axis lines 67*a* and 77*a* of the respective bearing portions 72*b* supporting the winding shaft 61 are aligned with each other. Accordingly, an angle formed by the first case 66 and the second case 76 is less likely to change, so wrenching of the winding shaft 61 is less likely to occur. Accordingly, an external load such as twisting or wrenching of the winding shaft 61 due to position shift of the respective parts supporting both ends of the winding shaft 61 can be suppressed.

(2) Each of the first case 66 and the second case 76 is fixed to the rigid coupling member 59 by two screws in the X-axis direction orthogonal to the winding axis line 61*a* of the winding shaft 61, thus the first case 66 and the second case 76 cannot rotate in the plane orthogonal to the winding axis line 61*a* of the winding shaft 61. That is, twisting of the winding shaft 61 does not occur. Further, with respect to the rigid coupling member 59, the first case 66 and the second case 76 are held so as to be non-rotatable with respect to each other, in a state in which the first main axis line 67*a* of the first main shaft 67 supporting the winding shaft 61, and the second main axis line 77*a* of the second main shaft 77 are aligned with the winding axis line 61*a* of the winding shaft 61, the angle formed by the first case 66 and the second case 76 does not change. In other words, wrenching of the winding shaft 61 does not occur. Accordingly, the user can move the first case 66 and the second case 76 simultaneously with a positional relationship unchanged. Thus, in addition to a case in which the winding unit is placed on a flat surface such as a floor surface, even during an operation of changing the winding amount of the supporting member 32, an external load such as twisting or wrenching of the winding shaft 61 due to position shift of the respective parts supporting both the end portions of the winding shaft 61 can be suppressed.

(3) In a state in which both the first installation surface 93 of the first case 66 and the second installation surface 94 of the second case 76 are in surface contact with the floor surface 91, the winding unit 60 is placed on a flat surface such as the floor surface 91. Accordingly, there is no rattling on the floor surface 91, an external load such as twisting or wrenching of the winding shaft 61 due to position shift of the respective parts supporting both ends of the winding shaft 61 can be suppressed.

(4) In a state in which both the first installation surface 93 of the first case 66 and the second installation surface 94 of the second case 76 are installed on the floor surface 91, each of the cases is fixed to the rigid coupling member 59 with the plurality of screws 58. Thus, in addition to a case in which the winding unit is placed on a flat surface such as a floor surface, when an operation of changing the unwind amount of the supporting member 32 is started, an external load such as twisting or wrenching of the winding shaft 61 due to position shift of the respective parts supporting both the end portions of the winding shaft 61 can be suppressed.

(5) The winding unit 60 includes the guide member 59*g* includes the straight portion 59*a* longer than the length of the supporting member 32 in the axial direction of the winding shaft 61, extending linearly in the axial direction of the winding shaft 61, and having a rectangular-shaped cross section orthogonal to the axial direction. Thus, when the user tries to bring the supporting member 32 into contact with the straight portion 59*a*, a fold extending in the width direction is formed at a site of the supporting member 32 contacting the straight portion 59*a*, thereby eliminating wrinkles in the supporting member 32. The user can wind the supporting member 32 around the winding shaft 61, for which the wrinkles are eliminated by the fold formed at the site contacting the straight portion 59*a*. In addition, since the coupling member 59 also serves as the guide member 59*g*, the number of components is kept low.

(6) The rotation mechanism 62 is provided inside the first case 66. Since the first case 66 covers the opposite side of the part to which the winding shaft 61 is mated in the first mating member 63 constituting the rotation mechanism 62, foreign matter cannot flow into the rotation mechanism 62. Thus, malfunction of the rotation mechanism 62 due to foreign matter can be prevented.

(7) The unwind amount regulating portion 70 is provided inside the second case 76. since the second case 76 covers the opposite side of the part to which the winding shaft 61 is mated in the second mating member 71 constituting the unwind amount regulating portion 70, foreign matter cannot flow into the winding amount restricting portion 70. Thus, malfunction of the unwind amount regulating portion 70 due to foreign matter can be prevented.

(8) Since the biasing force of the flat spiral spring 64 rotates the winding shaft 61 in the direction in which the supporting member 32 is wound, it is not necessary for the user itself to rotate the winding shaft 61 to change the unwind amount of the supporting member 32. An operation for changing the unwind amount of the supporting member 32 to be small can be facilitated. Also, when the use of the stacker unit 31 is ended, the supporting member 32 can be easily and rapidly wound around the winding shaft 61.

(9) Unless the operated portion 68*b* of the operation switch 68 is operated from the non-operating position protruding outward the outer surface of the first case 66 to the operating position located on the inner side of the first case 66 than the outer surface of the first case 66, the ratchet claw 65 does not disengage from the ratchet gear 63*a*, so the winding shaft 61 is not driven by the biasing force of the flat spiral spring 64. For example, when the operation switch 68 is pressed against the user's intent, for example, when a person's foot hits the operation switch 68, or when the winding unit 60 is accidentally overturned and the operation switch 68 is pressed, the stop mechanism 62*b* is not released, thus the winding mechanism 62*a* can be prevented from being driven. Additionally, when the user operates the operation switch 68 with the intention of winding the supporting member 32, the operated portion 68*b* of the operation switch 68 is operated from the non-operating position protruding outward the outer surface of the first case 66 to the operating position located on the inner side of the first case 66 than the outer surface of the first case 66. Accordingly, the ratchet claw 65 disengages from the ratchet gear 63*a*, and the winding shaft 61 is driven by the biasing force of the flat spiral spring 64.

(10) The leg portion 80 of the printer 11 includes the plurality of rollers 81*a* that contact a surface such as the floor surface 91 on which the printer 11 is installed and are rotatable, the locking lever 81*b* that regulates rotation of the roller 81*a*, and the placement surfaces 82 and 83 on which the winding unit 60 is placed. When the user adjusts the unwind amount of the supporting member 32, winds the supporting member 32 around the winding shaft 61, or moves the stacker unit 31, the printer 11 is pulled through the supporting member 32. However, by locking the roller 81*a* of the base 96, movement of the printer 11 can be prevented. Furthermore, after use of the stacker unit 31 is ended, by placing the stacker unit 31 on the first placement surface 82 and the second placement surface 83 provided on the base 96 of the leg portion 80, the stacker unit 31 can be compactly housed.

(11) When the winding unit 60 rotates in the direction in which the supporting member 32 is unwound, the rope 69 is gradually wound around the planetary pulley 75. When the planetary pulley 75 completely winds the rope 69, the user will not be able to unwind the supporting member 32 anymore, thus the user can be prevented from excessively unwinding the supporting member 32. For example, in a case in which the supporting member 32 is unwound, when the winding shaft 61 is excessively rotated in the unwinding direction W1, thus an end in the unwinding direction W1 of the supporting member 32 is exceeded, winding of the supporting member 32 is started in an opposite winding direction. In this case, an extra operation occurs such as reversing of the supporting member and slight winding. Compared to this, in the present exemplary embodiment, when the unwind amount exceeds a predetermined amount, the rotation of the winding shaft 61 in the unwinding direction W1 is regulated by the unwind amount regulating portion 70, thus the above-described inconvenience can be avoided.

(12) When the winding unit 60 rotates in the direction in which the supporting member 32 is wound, the rope 69 is gradually wound around the sun pulley 79. When the sun pulley 79 completely winds the rope 69, the user will not be able to wind the supporting member 32 anymore, thus the user can be prevented from excessively winding the supporting member 32. For example, in a case in which the supporting member 32 is wound, when the winding shaft 61 is rotated excessively in the winding direction W2, and in a case of a configuration in which the attachment shaft 36 is provided on a tip of the supporting member 32, or in case of a configuration in which the adjuster 43 and the guide string 44 are provided near the tip of the supporting member 32, there is a concern that these components collide with or are caught in constituent elements of the stacker unit 31 when the supporting member 32 is wound. Compared to this, in the present exemplary embodiment, when the unwind amount is smaller than a predetermined amount, the rotation of the winding shaft 61 in the winding direction W2 is regulated by the unwind amount regulating portion 70, thus the above-described inconvenience can be avoided.

(13) The printer 11 includes the support shaft 86 on which the supporting member 32 is hung, and that supports the supporting member that is hung, and the pair of support shaft holding members 87 that hold both the ends of the support shaft 86 respectively, and are rotatably attached to the base 96 of the leg portion 80 of the printer 11. In the direction in which the printer 11 discharges the medium 99 after printing, the winding unit 60 is placed at the position on the floor surface 91 facing the position where the part of the supporting member 32 is fixed to the printer 11, with the support shaft 86 interposed therebetween. A part of tip of the supporting member 32 unwound from the winding unit 60 is fixed to a position lower than the support shaft 86 in the printer 11, in a state in which the supporting member 32 is hung on the support shaft 86 positioned higher than the winding unit 60. By setting the support shaft holding member 87 to a desired angle to change the position of the support shaft 86, the posture of the supporting member 32 loading the medium 99 is changed.

When the supporting member 32 is attached to the printer 11 in the forward discharge posture in which the medium 99 is discharged forward the discharge port 13, the user increases the unwind amount of the support member 32, moves the position of the support shaft 86 rearward the medium transporting surface of the discharge guide 27, and installs the winding unit 60 at a position far from the printer 11. The medium 99 is loaded on the supporting member 32 in a posture in which a printed surface faces upward. On the other hand, when the supporting member 32 is attached to the printer 11 in the rearward discharge posture in which the medium 99 is discharged rearward the discharge port 13, the user decreases the unwind amount of the support member 32, moves the position of the support shaft 86 forward the medium transporting surface of the discharge guide 27, and installs the winding unit 60 at a position close to the printer 11. The medium 99 is loaded on the supporting member 32 in a posture in which a printed surface faces downward. The user can switch the supporting member 32 between the forward discharge posture and the rearward discharge posture, by the aforementioned easy operation.

(14) The winding type stacker unit 31 that is an example of a loading apparatus, includes the sheet-like supporting member 32 that is fixed in part to the printer 11 and is used, and capable of supporting the medium 99 discharged from the discharge port 13 of the printer 11, and the winding unit 60 capable of winding the supporting member 32. The winding unit 60 includes the winding shaft 61 to which the one end of the supporting member 32 is attached, the rotation mechanism 62, the first case 66 and the second case 76 that rotatably support both the end portions of the winding shaft 61 respectively, and the placement portion 57 that places the winding unit 60 on a flat surface. The rotation mechanism 62 includes the winding mechanism 62*a* for rotating the winding shaft 61 in the direction in which the supporting member 32 is wound, and the stop mechanism 62*b* that can stop the winding shaft 61 in the first state in which the length of the supporting member 32 unwound from the winding unit 60 is the first unwind amount, and in the second state in which the length of the supporting member unwound from the winding shaft is the second unwind amount greater than the first unwind amount. The first case 66 is positioned on one side outer than the supporting member 32, in the axial direction of the winding shaft 61, and rotatably supports the winding shaft 61. The second case 76 is positioned on another side outer than the supporting member 32, in the axial direction, and rotatably supports the winding shaft 61. By attaching the stacker unit 31 to the printer 11, identical effects to that of the medium processing apparatus 10 can be obtained.

(15) The medium loading method is a method for using the stacker unit 31 including the winding unit 60 and the supporting member 32 in the medium processing apparatus 10, to load the medium 99 subjected to printing processing and discharged from the discharge port 13 of the printer 11. The printer 11 includes the support shaft 86 on which the supporting member 32 is hung, and that supports the supporting member that is hung, and the pair of support shaft holding members 87 that hold both the ends of the support shaft 86 respectively, and are rotatably attached to the printer 11. A part of the supporting member 32 unwound from the winding unit 60 is fixed to the printer 11, and in the direction in which the printer 11 discharges the medium 99 after printing, the winding unit 60 is placed at the position facing the position where the part of the supporting member 32 is fixed to the printer 11, with the support shaft 86 interposed therebetween. The supporting member 32 unwound from the winding unit 60 is brought into a state of being hung on the support shaft 86 positioned higher than the winding unit 60. By adjusting the support shaft holding member 87 to a desired angle to change the position of the support shaft 86, the posture of the supporting member 32 loading the medium 99 is changed. By changing the position of the support shaft 86, the posture of the support member 32 can be switched between the forward discharge posture in which the medium 99 discharged from the discharge port 13 is discharged forward and is loaded on the supporting member 32, and the rearward discharge posture in which the medium 99 discharged from the discharge port 13 is discharged rearward and is loaded on the supporting member 32.

Note that, the above-described exemplary embodiment may be modified to an embodiment such as the following modified examples. Furthermore, an appropriate combination of the above-described exemplary embodiment and modification examples described below can be regarded as a further modification example, or an appropriate combination of the following modified examples can be regarded as a further modification example.

Figure 10A:
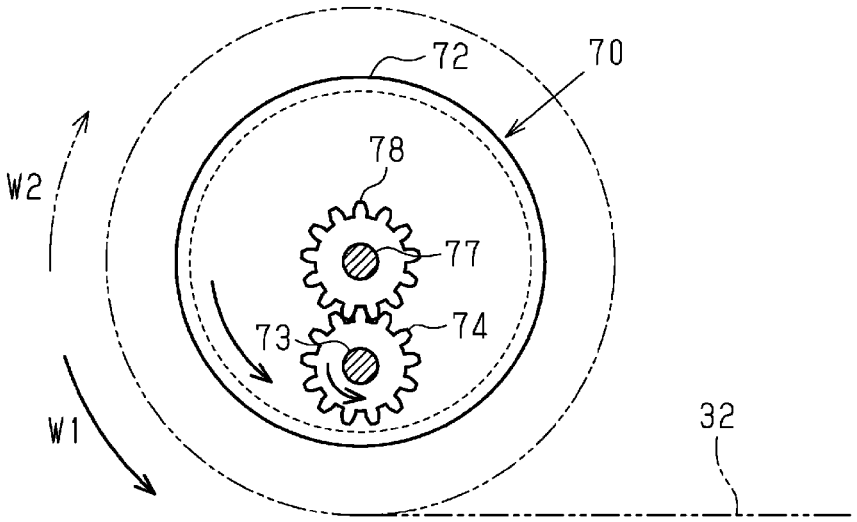
FIG. 10A is a schematic view illustrating an unwind amount regulating portion of a modified example.
Figure 10B:
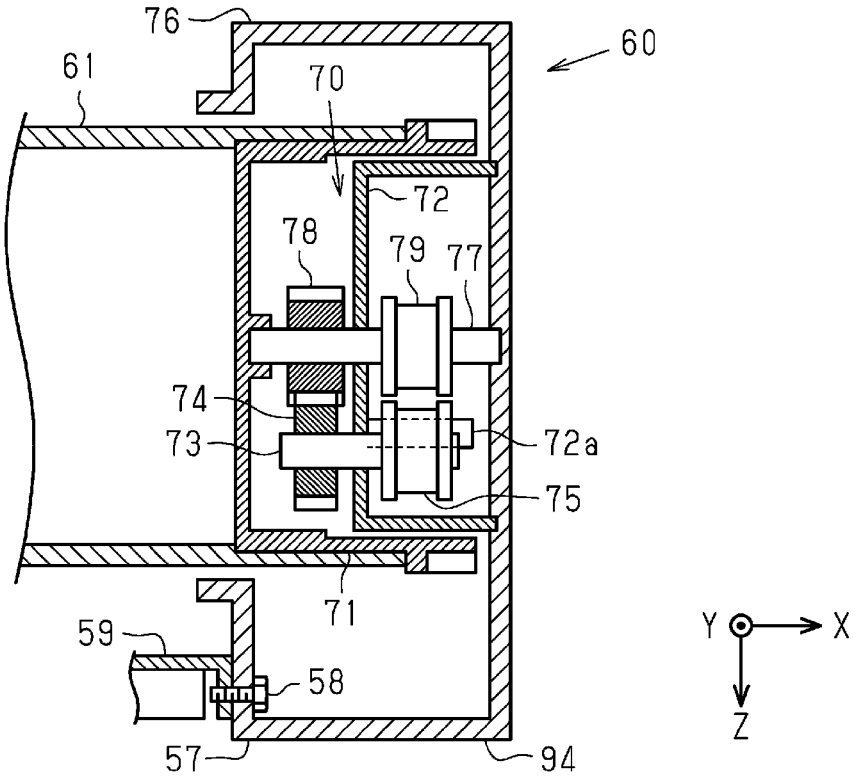
FIG. 10B is a schematic cross-sectional view illustrating an unwind amount regulating portion of the modified example.
Figure 10C:
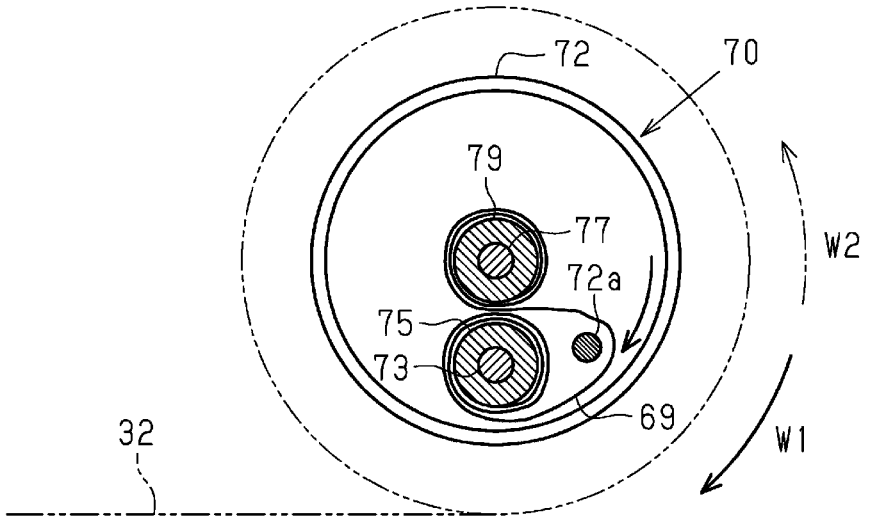
FIG. 10C is a schematic view of the unwind amount regulating portion of the modified example, as viewed from a side opposite to FIG. 10A.

In the present exemplary embodiment, the rope 69 is wound by the planetary movement of the planetary pulley 75, by rotating the disk member 72, in the state in which the sun gear 78 and the sun pulley 79 fixed to the second main shaft 77 are fixed to the second case 76. As illustrated in FIG. 10A to FIG. 10C, the unwind amount regulating portion 70 may rotate the sun gear 78 and the sun pulley 79 fixed to the second main shaft 77, in a state in which the disk member 72 is fixed to the second case 76. Even when the unwind amount regulating portion 70 is configured as illustrated in FIG. 10A to FIG. 10C, the rope 69 is wound.

Figure 11:
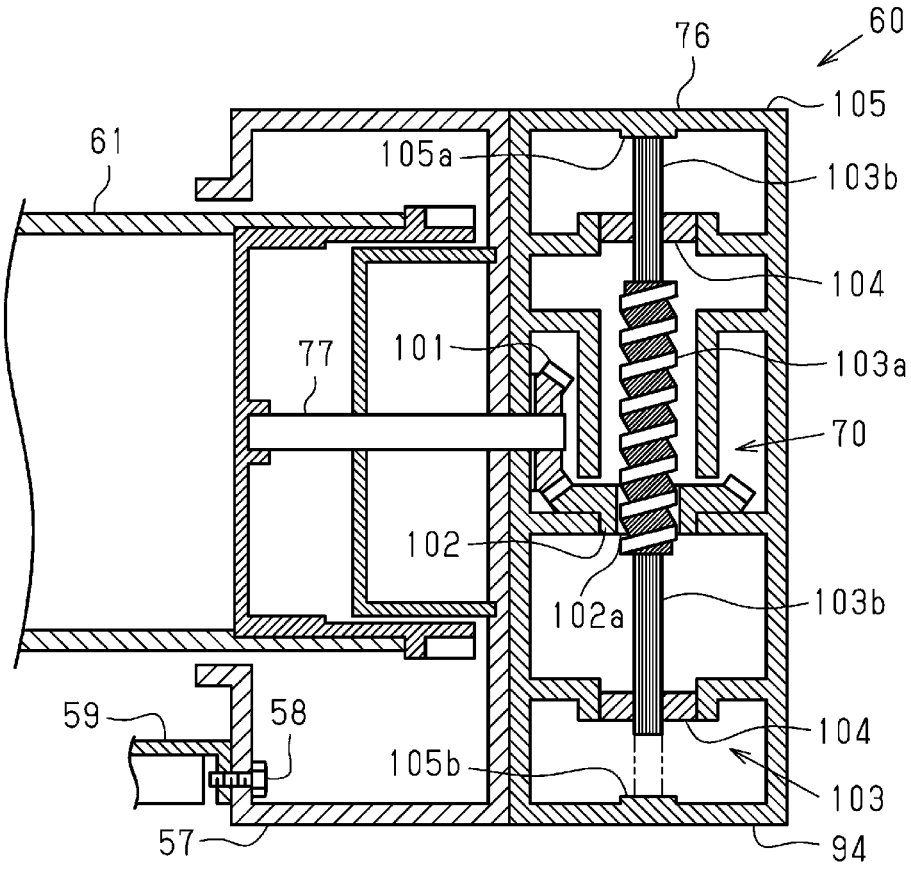
FIG. 11 is a schematic view illustrating a modified example in which a lead screw is used in an unwind amount regulating portion.

The unwind amount regulating portion 70 may be another mechanism. For example, as illustrated in FIG. 11, a first bevel gear 101 is fixed to the second main shaft 77. The first bevel gear wheel 101 intermeshes with a second bevel gear 102. The second bevel gear 102 includes a screw nut portion 102*a* in an inner circumference thereof, and intermeshes with a lead screw portion 103*a* of a lead screw 103. The lead screw 103 includes spline portions 103*b* on both end portions of the lead screw portion 103*a* respectively. The spline portion 103*b* is guided by the spline nut 104 so as to be non-rotatable and axially movable. When the first bevel gear 101 rotates, the second bevel gear 102 rotates, and the lead screw 103 reciprocates axially. Rotation of the second main shaft 77 is regulated by an end face of the lead screw 103 hitting a first stopper 105*a* or the second stopper 105*b* formed at respective opposing inner wall surfaces in a case 105 constituting the second case 76. In other words, the unwind amount of the supporting member 32 is regulated.

There may be a plurality of the coupling members 59 that fix the first case 66 and the second case 76 to each other. The coupling members 59 may be provided on both a front and a rear in a direction along the Y-axis with respect to the winding shaft 61. According to this configuration, compared to the configuration of the above-described exemplary embodiment, since twisting or wrenching of the winding shaft 61 does not occur, required strength for the coupling member 59 is suppressed to be small.

The method of fixing the first case 66 and the second case 76 to the coupling member 59 is not limited to fastening by screws. Other fixing methods such as mating may be used, or the first case 66, the second case 76, and the coupling member 59 may be integrally formed as one component. It is sufficient that fixing can be made so that twisting or wrenching does not occur between the first case 66 and the second case 76.

The coupling member 59 and guide member 59*g* may be configured with respective separate members. In this case, the guide member 59*g* may be attached or affixed to a surface of the coupling member 59. Furthermore, a component formed integrally with the first case 66, the second case 76, and the coupling member 59 may have the straight portion 59*a*, or the guide member 59*g* may be attached or affixed to the component.

In the exemplary embodiment described above, the user brings the surface (back surface) on the side of the floor of the supporting member 32 in contact with the straight portion 59*a* of the guide member 59*g* as an example of the coupling member, but may also bring a surface (front surface) opposite to the side of the floor of the supporting member 32 into contact with the straight portion 59*a*. For example, the winding direction of the supporting member 32 with respect to the winding shaft 61 is reversed from that of the above-described exemplary embodiment, and the guide member 59*g* is disposed above along the Z-axis with respect to the winding shaft 61, and the surface (front surface) opposite to the side of the floor of the supporting member 32 is brought into contact with the straight portion 59*a*.

In the above-described exemplary embodiment, the user slightly inclines the winding unit 60 with respect to the floor, and brings the back surface of the supporting member 32 in contact with the straight portion 59*a* of the guide member 59*g*, but a configuration may be adopted in which the supporting member 32 constantly contacts the straight portion 59*a*, with the winding unit 60 placed on the floor.

The guide member 59*g* may be above the winding shaft 61, with the winding unit 60 placed. When winding the supporting member 32 around the winding shaft 61, the user inverts the winding unit 60 vertically to bring the front surface of the supporting member 32 into contact with the straight portion 59*a*.

The radius of curvature of the corner portion of the straight portion 59*a* is not limited to the range of 2 to 8 mm. However, when the radius of curvature is too large, a function as a guide during winding deteriorates. When the radius of curvature is too small, the front surface of the supporting member 32 is loaded when being wound, and the front surface of the supporting member 32 is easily damaged. For example, the radius of curvature may be a predetermined value within a range of 1 mm to 15 mm. Note that, the roundness of the corner portion of the straight portion 59*a* may be removed.

A part of the supporting member 32 that is fixed to the printer 11 may be fixed to the housing 12. For example, in the supporting member 32 provided with the attachment shaft 36 on the tip thereof, a part of the supporting member 32 is fixed to the housing 12, by fixing the attachment shaft 36 to the housing 12 of the printer 11. Additionally, there may be a plurality of fixing locations. As a fixing destination of a part of the supporting member 32, the user may select the housing 12 or the leg portion 80, to attach the part of the supporting member 32 to the selected one. Also, when the leg portion 80 is selected as the fixing destination of the part of the supporting member 32, the part may be attached to the base 96 of the leg portion 80, or to the stand 95 of the leg portion 80.

For the supporting member 32, in place of the attachment shaft 36, a panel provided with a plurality of mounting holes is fixed, and the mounting hole may be hooked on the housing 12, or a mounting hole may be provided in the supporting member 32 itself, and the mounting hole may be hooked on the housing 12.

The placement portion 57 is not limited to a configuration including the bottom of the first case 66 and the bottom of the second case 76. For example, the first case 66 and the second case 76 may be fixed to an upper surface of the coupling member 59, and a bottom of the coupling member 59 may be the placement portion 57. Further, another member may be fixed to the coupling member 59, and a bottom of the member may be the placement portion 57.

Each of the first installation surface 93 that is a bottom of a part corresponding to the first case 66 in the winding unit 60, and the second installation surface 94 that is a bottom of a part corresponding to the second case 76, is not limited to a flat surface, and may be a surface constituted by a plurality of convex portions. For example, each of the first installation surface 93 and the second installation surface 94 may be a surface having a plurality of, three or more, convex portions. In this case, three or more convex portions of the first installation surface 93 and three or more convex portions of the second installation surface 94 contact an identical flat surface.

The first installation surface and the second installation surface are not limited to the respective bottoms of the first case 66 and the second case 76. The first case 66 and the second case 76 may be fixed to the upper surface of the coupling member 59, and a bottom of a part corresponding to the first case 66 of the coupling member 59 may also be the first installation surface, and a bottom of a part corresponding to the second case 76 may also be the second installation surface. Further, other members may be fixed to the cases 66 and 76, respectively, and bottoms of the respective members may also be the first installation surface and the second installation surface, respectively.

The rotation mechanism 62 may also be provided inside the second case 76, or may also be provided inside both the first case 66 and the second case 76. When a rotating biasing portion such as the flat spiral spring 64, and the stop mechanism 62*b* that regulates rotation of the winding shaft 61 by the rotary biasing portion are provided inside an identical case, a possibility that the winding shaft 61 twists is reduced. When the rotation mechanism 62 is provided inside the second case 76, the second case 76 is also provided with the operation switch 68 that releases the stop mechanism 62*b*.

A configuration may also be adopted in which the operated portion 68*b* is provided on the ratchet claw 65, and the stop mechanism 62*b* is released, when the operated portion 68*b* is operated from the non-operating position protruding outward the outer surface of the first case 66, to the operating position located on the inner side of the case than the outer surface. In this case, a dedicated component is not required for the operation switch 68.

The rotary biasing portion is not limited to the flat spiral spring 64. For example, a torsion spring having a large winding number, or a torsion spring that can be twisted multiple times may be used.

The drive unit for driving the winding shaft 61 to rotate may also be a motor. In addition to the operation switch 68 that rotates the winding shaft 61 in the winding direction W2, an operation switch that rotates the winding shaft 61 in the unwinding direction W1 may be provided, and rotation in either direction of the winding shaft 61 may also be driven by a motor.

The winding mechanism 62*a* that configures the rotation mechanism 62 may have a configuration that does not include a drive unit such as the flat spiral spring 64 or a motor. The winding mechanism 62*a* may be configured such that winding and unwinding of the supporting member 32 are performed by manual rotation by the user.

In the ratchet gear 63*a*, a tooth may be absent every other tooth, or may be absent at a certain cycle. For example, when a tooth is absent every other tooth, a minimum unit of unwinding length is doubled. When there is only one tooth on a circumference, the minimum unit of unwinding length is a circumferential length corresponding to one circumference of the winding shaft.

The stop mechanism 62*b* may be a one-way clutch instead of a ratchet mechanism.

A configuration may be adopted in which, as in a case of a roll curtain attached to a window of a house or a vehicle, after the supporting member 32 is slightly unwound by the user, and when tension of the supporting member 32 is slightly loosened, the supporting member 32 is automatically wound. In this case, the operation switch 68 is not required.

The placement surfaces 82 and 83 on which the winding unit 60 is placed may be provided on the stand 95 of the leg portion 80, or may be provided on the housing 12.

When displaying an installation method of the stacker unit 31, in order for the user to lock the roller 81*a* of the printer 11 to prevent the printer 11 from moving, a screen of caution may be displayed on a display screen of a display device provided on the printer 11.

The rope 69 may be metal such as stainless steel, or may be a synthetic resin such as polyester or nylon. The rope 69 may be formed by intertwining many ultrafine wires together, or may be subjected to a coating process of a synthetic resin for durability and corrosion resistance.

The unwind amount regulating portion 70 may be provided inside the first case 66. Both the rotation mechanism 62 and the unwind amount regulating portion 70 may be provided inside the first case 66.

In the present exemplary embodiment, the sun gear 78 and the planetary gear 74 are identical in the number of teeth, but the present disclosure is not limited thereto. For example, in a case in which a ratio of the number of teeth of the sun gear 78 to the number of teeth of the planet gears 74 is 2:1, when the disk member 72 rotates once in a clockwise direction, the planetary gear 74 rotates twice in the clockwise direction. In this case, by setting a ratio of a pulley diameter of the sun pulley 79 to a pulley diameter of the planetary pulley 75 to 2:1, an unwinding length of the rope 69 of the sun pulley 79 and a winding length of the rope 69 of the planetary pulley 75 are equalized. That is, it is sufficient that the ratio of the number of teeth of the sun gear 78 to the number of teeth of the planetary gear 74, and the ratio of the pulley diameter of the sun pulley 79 to the pulley diameter of the planetary pulley 75 are set to be identical. The number of teeth of each of the sun gear 78 and the planetary gear 74 can be set as appropriate.

The rope 69 may be wound in an opposite direction. However, when the sun pulley 79 unwinds the rope 69, the planetary pulley 75 winds the rope 69, and when the sun pulley 79 winds the rope 69, the planetary pulley 75 unwinds the rope 69.

A configuration may be adopted in which a ring gear that intermeshes with the planetary gear 74 is provided on an inner surface of an outer circumference of the second mating member 71 instead of the sun gear 78, and the planetary gear 74 is moved as a planet by rotating the ring gear, and the sun pulley 79 unwinds the rope 69, and the planetary pulley 75 winds the rope 69.

Depending on users, a length of the rope 69 may be changed. A required unwinding length of the supporting member 32 differs for a user using a medium having a large length in the transport direction, and a user using only a medium having a small length in the transport direction. When the length of the rope 69 is decreased for the user using only the medium having the small length in the transport direction, excessive unwinding of the supporting member 32 by the user can be prevented.

Hereinafter, technical concepts and effects thereof that are understood from the above-described exemplary embodiments and modified examples will be described.

(A) A medium processing apparatus includes, a printer provided with a discharge unit for discharging a processed medium, a supporting member having a sheet-like shape and fixed, in part, to the printer, and moreover configured to support the medium discharged from the discharge unit, and a winding unit configured to wind the supporting member and move with respect to the printer, wherein the winding unit includes a winding shaft to which one end of the supporting member is attached, a rotation mechanism including a winding mechanism for rotating the winding shaft in a direction of winding the supporting member and a stop mechanism configured to stop the winding shaft, in a first state in which a length of the supporting member unwound from the winding shaft is a first unwind amount, and in a second state in which a length of the supporting member unwound from the winding shaft is a second unwind amount that is greater than the first unwind amount, a first case positioned at one outer side of the supporting member in an axial direction of the winding shaft and rotatably supporting the winding shaft, a second case positioned at another outer side of the supporting member in the axial direction and rotatably supporting the winding shaft, and a placement portion that, when the winding unit is placed on a flat surface, contacts the flat surface.

According to this configuration, the winding shaft can be stopped, in the first state in which the unwind amount is the first unwind amount, and in the second state in which the unwind amount is the second unwind amount that is greater than the first unwind amount. An unwinding length of the supporting member is adjusted in accordance with a length of the medium, and additionally, the supporting member can be maintained at an adjusted length. Thus, the supporting member from a part fixed to the printer to the winding shaft can be held in a desired posture suitable for supporting the medium to be discharged. Additionally, the winding unit is placed on a flat surface such as a floor surface. Thus, compared to a configuration in which the winding shaft is supported by, for example, a pair of rotatable side rods, and the like, there is no concern about mutual position shift between the first case and the second case. In a state in which the winding unit is placed on a flat surface by the placement portion, for example, the first case and the second case are held so as to be non-rotatable with respect to each other in a plane orthogonal to an axis line of the winding shaft. Accordingly, twisting of the winding shaft is unlikely to occur. Additionally, for example, the first case and the second case are held so as to be non-rotatable with respect to each other in a state in which axis lines of the respective bearing portions supporting the winding shaft are aligned with each other. Accordingly, an angle formed by the first case and the second case is less likely to change, so wrenching of the winding shaft is less likely to occur. Accordingly, an external load such as twisting or wrenching of the winding shaft due to position shift of respective parts supporting both ends of the winding shaft can be suppressed.

(B) In the above-described medium processing apparatus, the placement portion may include a first installation surface including a bottom of the first case, and a second installation surface including a bottom of the second case, and when the first installation surface contacts a flat surface, the second installation surface may contact the flat surface.

According to this configuration, the first case and the second case are, in a state in which both the first installation surface and the second installation surface contact a flat surface such as a floor surface, placed on the flat surface. In a state in which the winding unit is placed, the first case and the second case are placed on a flat surface such as a floor surface without rattling, thus are held in a state of being non-rotatable with respect to each other. Thus, an external load such as twisting or wrenching of the winding shaft due to position shift of the respective parts supporting both ends of the winding shaft can be suppressed.

(C) The above-described medium processing apparatus may include a coupling member configured to fix the first case and the second case to be non-rotatable with respect to each other in the plane orthogonal to the axis line of the winding shaft.

According to this configuration, the first case and the second case are fixed to each other via the coupling member, thus are held so as to be non-rotatable with respect to each other in the plane orthogonal to the axis line of the winding shaft. Thus, in addition to a case in which the winding unit is placed on a flat surface such as a floor surface, even when an operation of changing an unwind amount of the supporting member is started, an external load such as twisting or wrenching of the winding shaft due to position shift of the respective parts supporting both the end portions of the winding shaft can be suppressed.

(D) In the above-described medium processing apparatus, a configuration may be adopted in which, the winding unit includes a guide member having a straight portion that guides the supporting member contacting therewith, and the straight portion has a length longer than the length of the supporting member in the axial direction of the winding shaft, extends along the axial direction, and has a cross section that has a is a convex shape orthogonal to the axial direction.

According to this configuration, when a user tries to, by the straight portion in the winding unit that serves as a guide when the supporting member is wound, bring the supporting member into contact with the straight portion of the guide member, a fold extending in a width direction is formed at a site of the supporting member contacting the straight portion, thereby eliminating wrinkles in the supporting member. The user can wind the supporting member around the winding shaft, for which the wrinkles are eliminated by the fold formed at the site contacting the straight portion.

(E) In the above-described medium processing apparatus, the rotation mechanism may also be provided inside at least one of the first case and the second case.

According to this configuration, malfunction of the rotation mechanism due to inflow of foreign matter can be prevented.

(F) In the above-described medium processing apparatus, the winding mechanism may include a drive unit for driving the winding shaft to rotate.

According to this configuration, since the drive unit rotates the winding shaft, it is not necessary for the user itself to rotate the winding shaft to change the unwind amount of the supporting member. The operation for changing the unwind amount of the supporting member can be facilitated.

(G) In the above-described medium processing apparatus, the drive unit may be a rotary biasing portion for biasing the winding shaft in a winding direction.

According to this configuration, since the rotary biasing portion rotates the winding shaft in the winding direction in which the supporting member is wound, it is not necessary for the user itself to rotate the winding shaft to reduce the unwind amount of the supporting member. Thus, an operation of reducing the unwind amount of the supporting member can be facilitated.

(H) In the above-described medium processing apparatus, a configuration may be adopted in which, in one of the first case and the second case that is provided with the rotation mechanism, an operation switch is provided that releases stop of the winding shaft by the stop mechanism, and rotates the winding shaft by the drive unit, and the operation switch includes a operated portion that is operated by the user, and the step by the stop mechanism is released when the operated portion is operated from a non-operating position, where the operated portion protrudes outward of an outer surface of the case, to an operating position located further inside of the case than the outer surface.

According to this configuration, unless the operated portion is operated from the non-operating position protruding outward the outer surface of the case, to the operating position located on the inner side of the case than the outer surface, the winding shaft is not driven. In other words, when the operated portion is pressed by an erroneous operation, the drive unit does not drive the rotation mechanism. For example, the drive unit can be prevented from driving the rotation mechanism, by unintentional operations, such as a person's foot hitting the operation switch, accidental overturning of the winding unit to press the operation switch, and the like. Additionally, when the operated portion is operated from the non-operating position protruding outward the outer surface of the case, to the operating position located on the inner side of the case than the outer surface, the stop mechanism is released, and the winding shaft is driven. That is, when the operated portion is pushed down by an operation of the user, the drive unit can drive the winding mechanism.

(I) In the above-described medium processing apparatus, the printer may include a leg portion, and the leg portion may include: a plurality of rollers contacting a surface, at which the printer is installed and configured to rotate; a locking member regulating rotation of the roller; and a placement surface at which the winding unit is placed.

According to this configuration, in a case in which the user unwinds or winds the supporting member, or moves the winding unit, even when the printer is pulled via the supporting member, movement of the printer can be prevented by locking the roller of the leg portion.

(J) In the above-described medium processing apparatus, the winding unit may include an unwind amount regulating portion regulating an unwind amount of the supporting member, and the unwind amount regulating portion may regulate rotation of the winding shaft in the unwinding direction, when the unwind amount exceeds a predetermined amount. According to this configuration, the unwind amount of the supporting member can be regulated so as not to exceed the predetermined amount, thus it is possible to prevent the user from excessively unwinding the supporting member.

(K) In the above-described medium processing apparatus, the winding unit may include an unwind amount regulating portion regulating an unwind amount of the supporting member, and the unwind amount regulating portion may regulate rotation of the winding shaft in the winding direction, when the unwind amount is smaller than a predetermined amount. According to this configuration, the unwind amount of the supporting member can be regulated so as to be a length equal or smaller than the predetermined amount, thus it is possible to prevent the user from excessively winding the supporting member.

(L) In the above-described medium processing apparatus, the unwind amount regulating portion may also be provided inside at least one of the first case and the second case. According to this configuration, malfunction of the unwind amount regulating portion due to inflow of foreign matter can be prevented.

(M) In the medium processing apparatus, the printer includes a support shaft at which the supporting member is hung and which supports the supporting member that is hung, and a pair of support shaft holding members that hold both ends of the support shaft respectively and are rotatably attached to the printer, the supporting member unwound from the winding unit that is located in such a way that the support shaft interposed between the winding unit and a position, where the part of the supporting member is fixed to the printer in a direction in which the printer discharges the medium after printing, is fixed to a position lower than the support shaft in the printer, in a state of being hung at the support shaft that is positioned higher than the winding unit, and an angle of the support shaft holding member is adjusted and hence a posture of the supporting member loading the medium may be changed, thereby changing a posture of the support member onto which the medium is loaded shaft.

According to this configuration, the user can switch the supporting member between a forward discharge posture and a rearward discharge posture, by an easy operation for changing the position of the support shaft. When discharging the medium forward the discharge unit, the user increases the unwind amount of the supporting member, moves the position of the support shaft rearward the discharge unit, and installs the winding unit at a position far from the printer. The medium is loaded on the supporting member in a posture in which a printed surface after printing faces upward. When discharging the medium rearward the discharge unit, the user decreases the unwind amount of the supporting member, moves the position of the support shaft forward the discharge unit, and installs the winding unit at a position close to the printer. The medium is loaded on the supporting member in a posture in which a printed surface after printing faces downward.

(N) A loading apparatus is a loading apparatus that includes, a supporting member having a sheet-like shape and fixed, in part, to a printer and moreover configured to support a medium discharged from a discharge unit of the printer, and a winding unit configured to wind the supporting member, wherein the winding unit includes a winding shaft to which one end of the supporting member is attached, a rotation mechanism including a winding mechanism rotating the winding shaft in a direction of winding the supporting member and a stop mechanism configured to stop the winding shaft, in a first state in which a length of the supporting member unwound from the winding shaft is a first unwind amount, and in a second state in which a length is a second unwind amount that is greater than the first unwind amount, a first case positioned at one outer side of the supporting member in an axial direction of the winding shaft and rotatably supporting the winding shaft, a second case positioned at another outer side of the supporting member in the axial direction and rotatably supporting the winding shaft, and a placement portion that, when the winding unit is placed at a flat surface, contacts the flat surface. According to this configuration, by attaching the loading apparatus to the printer, similar effects to those of the above-described medium processing apparatus can be obtained.

(O) A media loading method is a medium loading method for loading a processed medium discharged from a discharge unit of a printer with use of a loading apparatus including the winding unit and the supporting member in a medium processing apparatus, wherein the printer includes a support shaft at which the supporting member is hung and which supports the supporting member that is hung, and a pair of support shaft holding members that hold both ends of the support shaft respectively and are rotatably attached to the printer, the method including fixing a part of the supporting member unwound from the winding unit to the printer, and, in a direction in which the printer discharges the medium after printing, placing the winding unit in such a way that the support shaft is interposed between the winding unit and a position, where the part of the supporting member is fixed to the printer, so as to bring the supporting member unwound from the winding unit into a state of being hung at the support shaft that is positioned higher than the winding unit, and adjusting an angle of the support shaft holding member to change a position of the support shaft, thereby changing a posture of the supporting member at which the medium is loaded.

According to this method, the user can switch the supporting member between the forward discharge posture and the rearward discharge posture, by an easy operation for changing the position of the support shaft. When discharging the medium forward the discharge unit, the user increases the unwind amount of the supporting member, moves the position of the support shaft rearward the discharge unit, and installs the winding unit at a position far from the printer. The medium is loaded on the supporting member in a posture in which a printed surface after printing faces upward. When discharging the medium rearward the discharge unit, the user decreases the unwind amount of the supporting member, moves the position of the support shaft forward the discharge unit, and installs the winding unit at a position close to the printer. The medium is loaded on the supporting member in a posture in which a printed surface after printing faces downward.

What is claimed is:

1. A medium processing apparatus, comprising:

a printer provided with a discharge unit discharging a processed medium;

a supporting member having a sheet-like shape and fixed, in part, to the printer, and moreover configured to support the medium discharged from the discharge unit; and a winding unit configured to wind the supporting member and move with respect to the printer, wherein the winding unit includes a winding shaft to which one end of the supporting member is attached, a rotation mechanism including a winding mechanism rotating the winding shaft in a direction of winding the supporting member and a stop mechanism configured to stop the winding shaft, in a first state in which a length of the supporting member unwound from the winding shaft is a first unwind amount, and in a second state in which a length of the supporting member unwound from the winding shaft is a second unwind amount that is greater than the first unwind amount, a first case positioned at one outer side of the supporting member in an axial direction of the winding shaft and rotatably supporting the winding shaft, a second case positioned at another outer side of the supporting member in the axial direction and rotatably supporting the winding shaft, and a placement portion that, when the winding unit is placed at a flat surface, contacts the flat surface.

2. The medium processing apparatus according to claim 1, wherein the placement portion includes a first installation surface including a bottom of the first case, and a second installation surface including a bottom of the second case, and when the first installation surface contacts a flat surface, the second installation surface contacts the flat surface.

3. The medium processing apparatus according to claim 1, comprising a coupling member configured to fix the first case and the second case to be non-rotatable with respect to each other in a plane orthogonal to an axis line of the winding shaft.

4. The medium processing apparatus according to claim 1, wherein the winding unit includes a guide member having a straight portion that guides the supporting member contacting therewith, and the straight portion has a length longer than a length of the supporting member in an axial direction of the winding shaft, extends along the axial direction, and has a cross section that has a convex shape orthogonal to the axial direction.

5. The medium processing apparatus according to claim 1, wherein the rotation mechanism is provided inside at least one of the first case and the second case.

6. The medium processing apparatus according to claim 1, wherein the winding mechanism includes a drive unit driving the winding shaft to rotate.

7. The medium processing apparatus according to claim 6, wherein the drive unit is a rotary biasing portion biasing the winding shaft in a winding direction.

8. The medium processing apparatus according to claim 6, wherein in one of the first case and the second case that is provided with the rotation mechanism, an operation switch is provided that releases stop of the winding shaft by the stop mechanism, and rotates the winding shaft by the drive unit, the operation switch includes an operated portion that is operated by a user, and the stop mechanism is released when the operated portion is operated from a non-operating position, where the operated portion protrudes outward of an outer surface of the case, to an operating position located further inside of the case than the outer surface.

9. The medium processing apparatus according to claim 1, wherein the printer includes a leg portion, and the leg portion includes: a plurality of rollers contacting a surface, at which the printer is installed, and configured to rotate; a locking member regulating rotation of the roller; and a placement surface at which the winding unit is placed.

10. The medium processing apparatus according to claim 1, wherein the winding unit includes an unwind amount regulating portion regulating an unwind amount of the supporting member, and the unwind amount regulating portion regulates rotation of the winding shaft in the unwinding direction, when the unwind amount exceeds a predetermined amount.

11. The medium processing apparatus according to claim 10, wherein the unwind amount regulating portion is provided inside at least one of the first case and the second case.

12. The medium processing apparatus according to claim 1, wherein the winding unit includes an unwind amount regulating portion regulating an unwind amount of the supporting member, and the unwind amount regulating portion regulates rotation of the winding shaft in the winding direction, when the unwind amount is smaller than a predetermined amount.

13. The medium processing apparatus according to claim 12, wherein the unwind amount regulating portion is provided within at least one of the first case and the second case.

14. The medium processing apparatus according to claim 1, wherein the printer includes a support shaft at which the supporting member is hung and which supports the supporting member that is hung, and a pair of support shaft holding members that hold both ends of the support shaft respectively and are rotatably attached to the printer, the supporting member unwound from the winding unit that is located in such a way that the support shaft is interposed between the winding unit and a position where the part of the supporting member is fixed to the printer in a direction in which the printer discharges the medium after printing, is fixed to a position lower than the support shaft in the printer, in a state of being hung at the support shaft that is positioned higher than the winding unit, and an angle of the support shaft holding members is adjusted and hence a position of the support shaft is changed, thereby changing a posture of the supporting member at which the medium is loaded.

15. A media loading method for loading a processed medium discharged from a discharge unit of a printer with use of a loading apparatus including the winding unit and the supporting member in the medium processing apparatus according to claim 1, the printer including a support shaft at which the supporting member is hung and which supports the supporting member that is hung, and a pair of support shaft holding members that hold both ends of the support shaft respectively and are rotatably attached to the printer, the method comprising:

fixing a part of the supporting member unwound from the winding unit to the printer, and, in a direction in which the printer discharges the medium after printing, placing the winding unit in such a way that the support shaft is interposed between the winding unit and a position where the part of the supporting member is fixed to the printer, so as to bring the supporting member unwound from the winding unit into a state of being hung at the support shaft that is positioned higher than the winding unit; and adjusting an angle of the support shaft holding members to change a position of the support shaft, thereby changing a posture of the supporting member at which the medium is loaded.

16. A loading apparatus, comprising:

a supporting member having a sheet-like shape and fixed, in part, to a printer, and moreover configured to support a medium discharged from a discharge unit of the printer; and a winding unit configured to wind the supporting member, wherein the winding unit includes a winding shaft to which one end of the supporting member is attached, a rotation mechanism including a winding mechanism rotating the winding shaft in a direction of winding the supporting member and a stop mechanism that is configured to stop the winding shaft, in a first state in which a length of the supporting member unwound from the winding shaft is a first unwind amount and in a second state in which a length of the supporting member unwound from the winding shaft is a second unwind amount that is greater than the first unwind amount, a first case positioned at one outer side of the supporting member in an axial direction of the winding shaft and rotatably supporting the winding shaft, a second case positioned at another outer side of the supporting member in the axial direction and rotatably supporting the winding shaft, and a placement portion that, when the winding unit is placed at a flat surface, contacts the flat surface.

* * * * *